US010399767B2

(12) United States Patent
Plaschkes et al.

(10) Patent No.: US 10,399,767 B2
(45) Date of Patent: Sep. 3, 2019

(54) METERED VALVE FOR DISPENSING PRODUCT

(71) Applicant: PRECISION VALVE CORPORATION, Greenville, SC (US)

(72) Inventors: Ran Plaschkes, Oestrich-Winkel (DE); Kai Theo Bauer, Mainz (DE); Rainer Heetfeld, Frankfurt am Main (DE)

(73) Assignee: PRECISION VALVE CORPORATION, Greenville, SC (US)

( * ) Notice: Subject to any disclaimer, the term of this patent is extended or adjusted under 35 U.S.C. 154(b) by 0 days.

(21) Appl. No.: 16/136,752

(22) Filed: Sep. 20, 2018

(65) Prior Publication Data

US 2019/0185251 A1 Jun. 20, 2019

Related U.S. Application Data

(60) Provisional application No. 62/607,741, filed on Dec. 19, 2017.

(51) Int. Cl.

| | |
|---|---|
| ***B65D 83/54*** | (2006.01) |
| ***B65D 83/62*** | (2006.01) |
| ***B65D 83/20*** | (2006.01) |
| ***B65D 83/52*** | (2006.01) |
| ***B65D 83/48*** | (2006.01) |

(52) U.S. Cl.

CPC ..... *B65D 83/546* (2013.01); *B65D 83/207* (2013.01); *B65D 83/48* (2013.01); *B65D 83/525* (2013.01); *B65D 83/62* (2013.01)

(58) Field of Classification Search

CPC .... B65D 83/546; B65D 83/207; B65D 83/48; B65D 83/52; B65D 83/54

USPC ..... 222/402.2; 128/200.23

See application file for complete search history.

(56) References Cited

U.S. PATENT DOCUMENTS

| | | | | |
|---|---|---|---|---|
| 2,772,820 | A | 12/1956 | O'Donnell | |
| 3,018,928 | A * | 1/1962 | Meshberg | B65D 83/425 222/335 |
| 3,052,382 | A * | 9/1962 | Gawthrop | B65D 83/54 222/335 |
| 3,180,535 | A * | 4/1965 | Ward | B65D 7/40 222/309 |
| 3,326,469 | A | 6/1967 | Abplanalp et al. | |
| 3,377,004 | A * | 4/1968 | Kjelson | B65D 83/54 222/402.2 |
| 3,616,971 | A | 11/1971 | Kutik | |

(Continued)

FOREIGN PATENT DOCUMENTS

| | | |
|---|---|---|
| EP | 2935042 A1 | 10/2015 |
| WO | 2014/028982 A1 | 2/2014 |

OTHER PUBLICATIONS

International Search Report dated Nov. 26, 2018 in corresponding International PCT Patent Application PCT/US2018/051948, 3 pages.

(Continued)

*Primary Examiner* — Patrick M. Buechner
*Assistant Examiner* — Michael J. Melaragno
(74) *Attorney, Agent, or Firm* — Ohlandt, Greeley, Ruggiero & Perle, L.L.P.

(57) ABSTRACT

The present device dispenses product from a pressurized container. The device has a metered valve that dispenses a predetermined fixed quantity of product upon actuation. The metered valve can be configured by the customer with a spacer to affect the amount of product continually metered.

20 Claims, 40 Drawing Sheets

(56) References Cited

U.S. PATENT DOCUMENTS

| | | | | |
|---|---|---|---|---|
| 3,743,146 | A * | 7/1973 | Schindler | A47K 5/1211 222/446 |
| 3,860,150 | A | 1/1975 | Maier | |
| 3,949,939 | A | 4/1976 | Brown | |
| 4,433,797 | A | 2/1984 | Galia | |
| 4,875,605 | A | 10/1989 | Weston | |
| 5,697,532 | A | 12/1997 | Wilde et al. | |
| 5,772,085 | A | 6/1998 | Bryant et al. | |
| 6,273,304 | B1 * | 8/2001 | Hoshino | B65D 83/207 222/402.2 |
| 7,699,192 | B2 | 4/2010 | Dunne | |
| 7,726,520 | B2 | 6/2010 | Harrold | |
| 7,793,806 | B2 | 9/2010 | Allsop | |
| 7,959,042 | B2 | 6/2011 | Twyman | |
| 8,678,248 | B2 | 3/2014 | Davideit et al. | |
| 8,763,865 | B2 | 7/2014 | De Man et al. | |
| 8,814,009 | B2 | 8/2014 | Hodson et al. | |
| 8,820,588 | B2 * | 9/2014 | Ghavami-Nasr | B65D 83/54 222/328 |
| 9,096,371 | B2 | 8/2015 | Allsop | |
| 9,254,954 | B2 | 2/2016 | Davideit et al. | |
| 9,522,403 | B2 * | 12/2016 | Hui | B05B 11/0056 |
| 2013/0092710 | A1 | 4/2013 | Bodet et al. | |
| 2017/0008692 | A1 | 1/2017 | Davideit et al. | |
| 2017/0021993 | A1 | 1/2017 | Martin | |

OTHER PUBLICATIONS

Written Opinion dated Nov. 26, 2018 in corresponding International PCT Patent Application PCT/US2018/051948, 12 pages.

* cited by examiner

METERED VALVE FOR DISPENSING PRODUCT

BACKGROUND OF THE DISCLOSURE

1. Field of the Disclosure

The present disclosure relates to a device for dispensing product from a pressurized container. In particular, the present disclosure relates to such devices having a metered valve that dispenses a predetermined fixed quantity of product upon actuation.

2. Description of Related Art

Aerosol dispensers are pressurized containers holding a liquid, powder gel, foam, oil or other product to be dispensed. Bag-on-Valve ("BOV") systems generally include an aerosol valve with a barrier, diaphragm, or bag welded to the valve that separates product from propellant. Other systems do not employ a barrier. In these other systems, product to be dispensed is contained by a lower portion of an upright container and pressurized gas that collects is contained in the space above the product. A dip tube that extends from the valve to the bottom of the container draws in and directs product to a discharge opening when the valve mechanism is actuated and the propellant provides force to expel the product from the container.

It would be desirable to dispense product in a predetermined or metered amount where precision or economy is needed. However, known metering devices can be quite complex requiring a number of separate components or elements and high manufacturing costs.

SUMMARY OF THE DISCLOSURE

The present disclosure provides a fixed dosage or metered valve that allows a user to obtain an equal dosage of product from a first and then each successive actuation.

The present disclosure also provides such a metered valve that repeatedly dispenses product from a container only in a fixed dosage with each activation.

The present disclosure further provides such a metered valve that has rapid sequential dispensing of metered dosages.

The present disclosure still further provides such a metered valve that when a user presses the actuator, only the amount of product accumulated in the dosing chamber is dispensed, and when the user releases the actuator, the dosing chamber is refilled with product again.

The present disclosure also provides such a valve that is metered and automatically directs product to fill a dispensing dose chamber in an inactivated state and to dispense the content from it in an activated state by a dispensing mechanism that includes a spring loaded piston and a dispensing dose chamber.

The present disclosure further provides such a valve that is metered and has a one way filling feature that allows a pressurized container to be filled with product through the valves stem so that the container is filled in one shot or action. This one way filling feature prevents product back flow or bypass metering prior to dispensing.

The present disclosure yet further provides such a valve that bypasses a dosing chamber during filling.

The present disclosure still further provides such a valve operable in bag less or a BOV system where product is completely separated from the propellant by the bag.

Accordingly, the present disclosure provides such a valve that in a BOV system, up to 100% product emptying, extended shelf life, even controlled spray patterns, and dispensing at any angle can be achieved.

The present disclosure further provides such a valve that is configurable to dispense both metered and unmetered amounts of product.

The present disclosure still further provides such a valve that is configurable with a spacer to dispense a variable metered amount of product.

Accordingly, the present disclosure provides such a valve that in the BOV systems disclosed herein, product dispensing is done by bag pressure, and therefore these systems are suitable for high viscosity products.

The metered valve according to the present disclosure can remarkably be configured to fit outside a can, inside the can, or inside a bag that is in the can.

The above and other objects, features, and advantages of the present disclosure will be apparent and understood by those skilled in the art from the following detailed description, drawings, and accompanying claims.

BRIEF DESCRIPTION THE DRAWINGS

Figure 17:
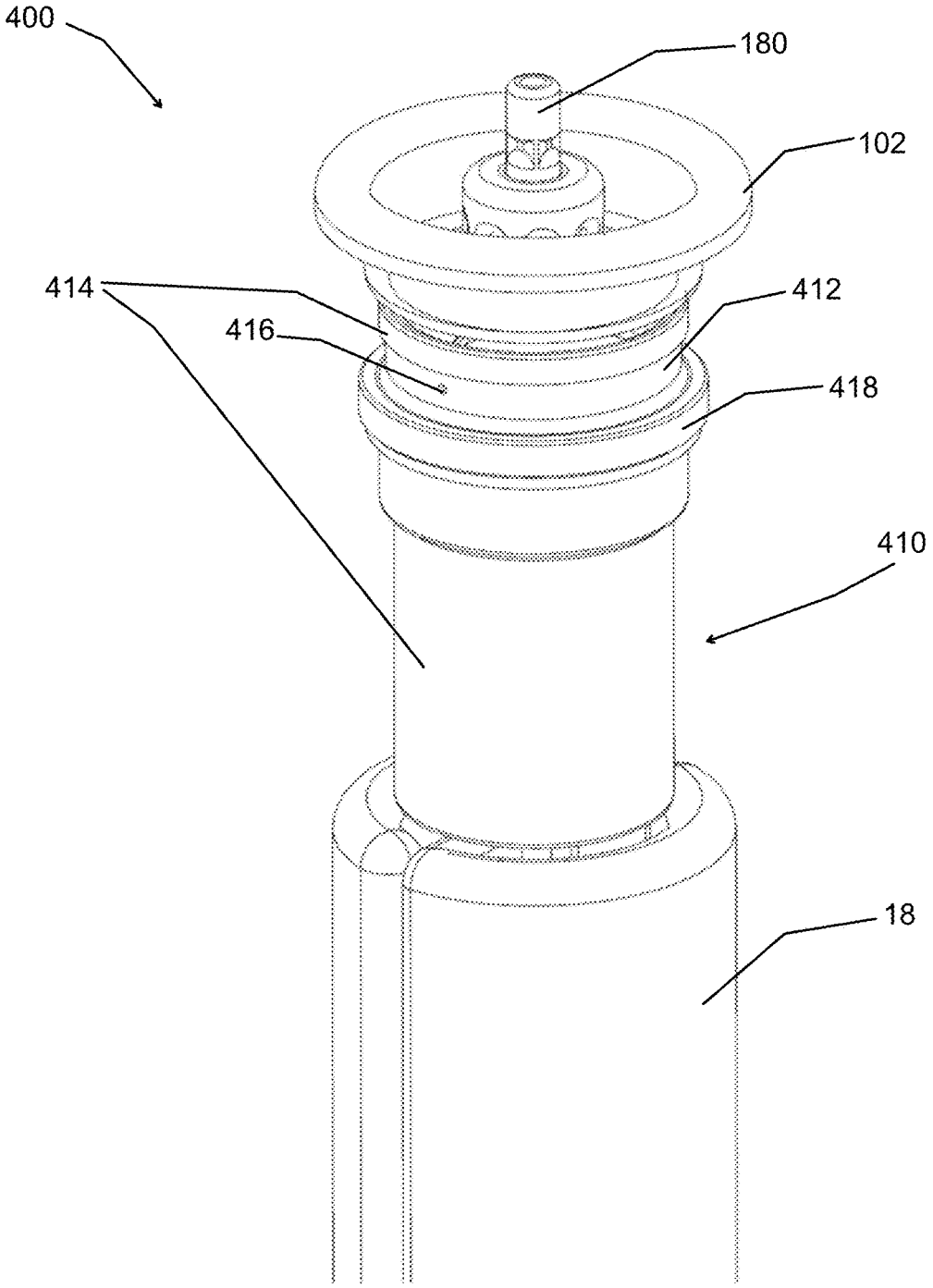
FIG. 17 is a perspective view of an alternative embodiment of a metered valve assembly according to the present disclosure.
Figure 18:
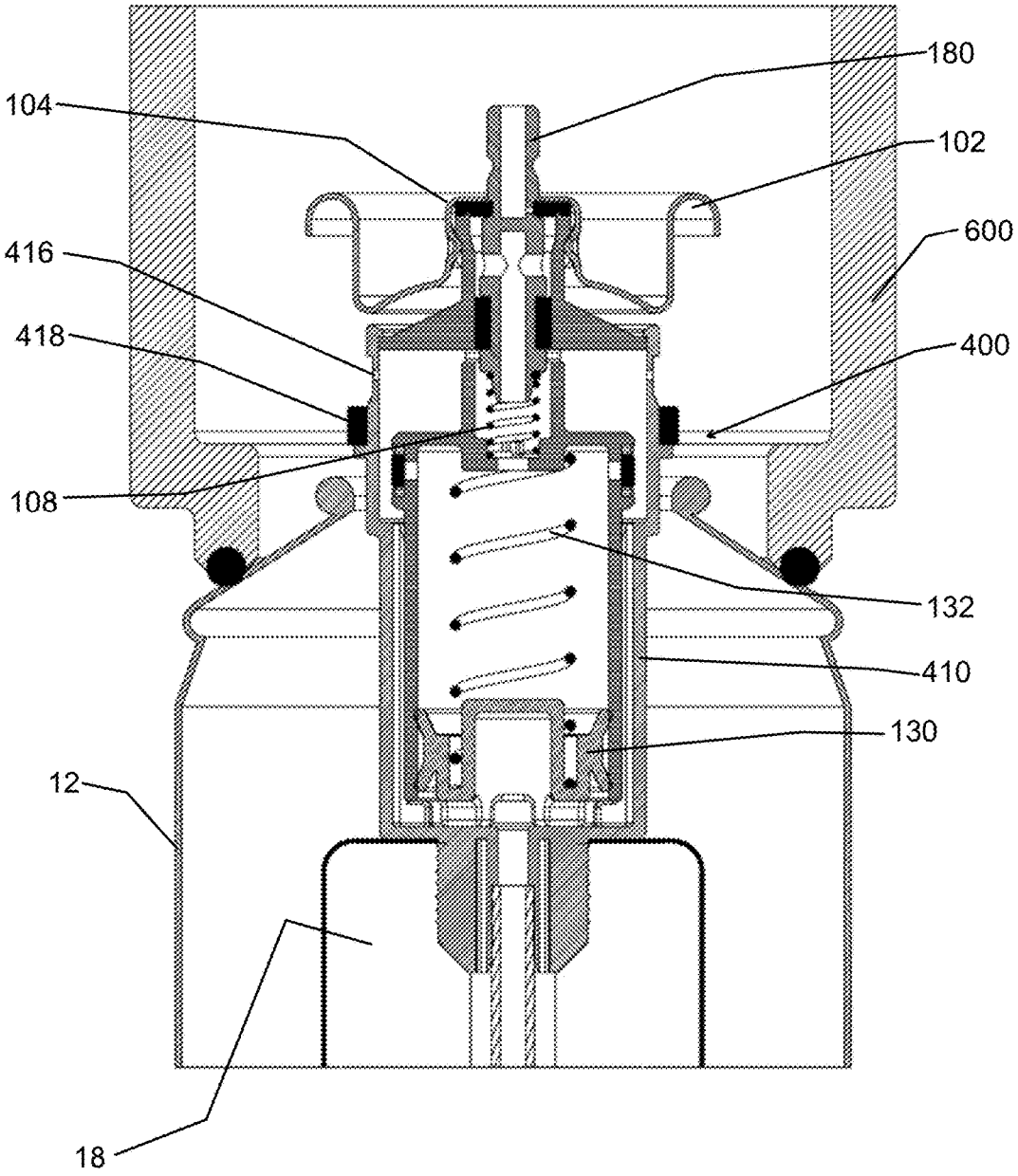

FIG. 18 cross sectional view of the metered valve assembly of FIG. 17 being inserted into a container.

Figure 19:
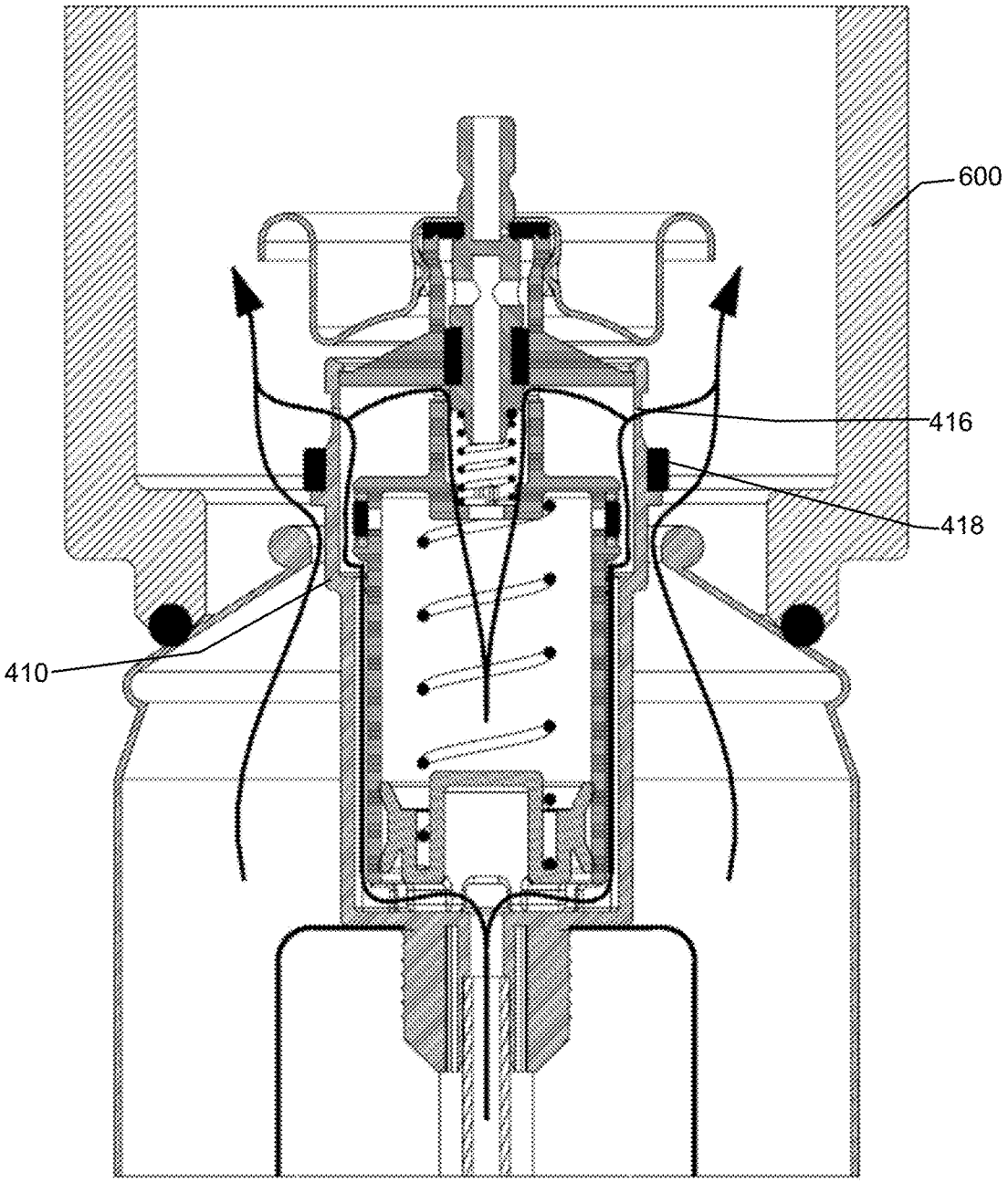

FIG. 19 is a cross sectional view of the metered valve assembly of FIG. 17 being vacuumed.

Figure 20:
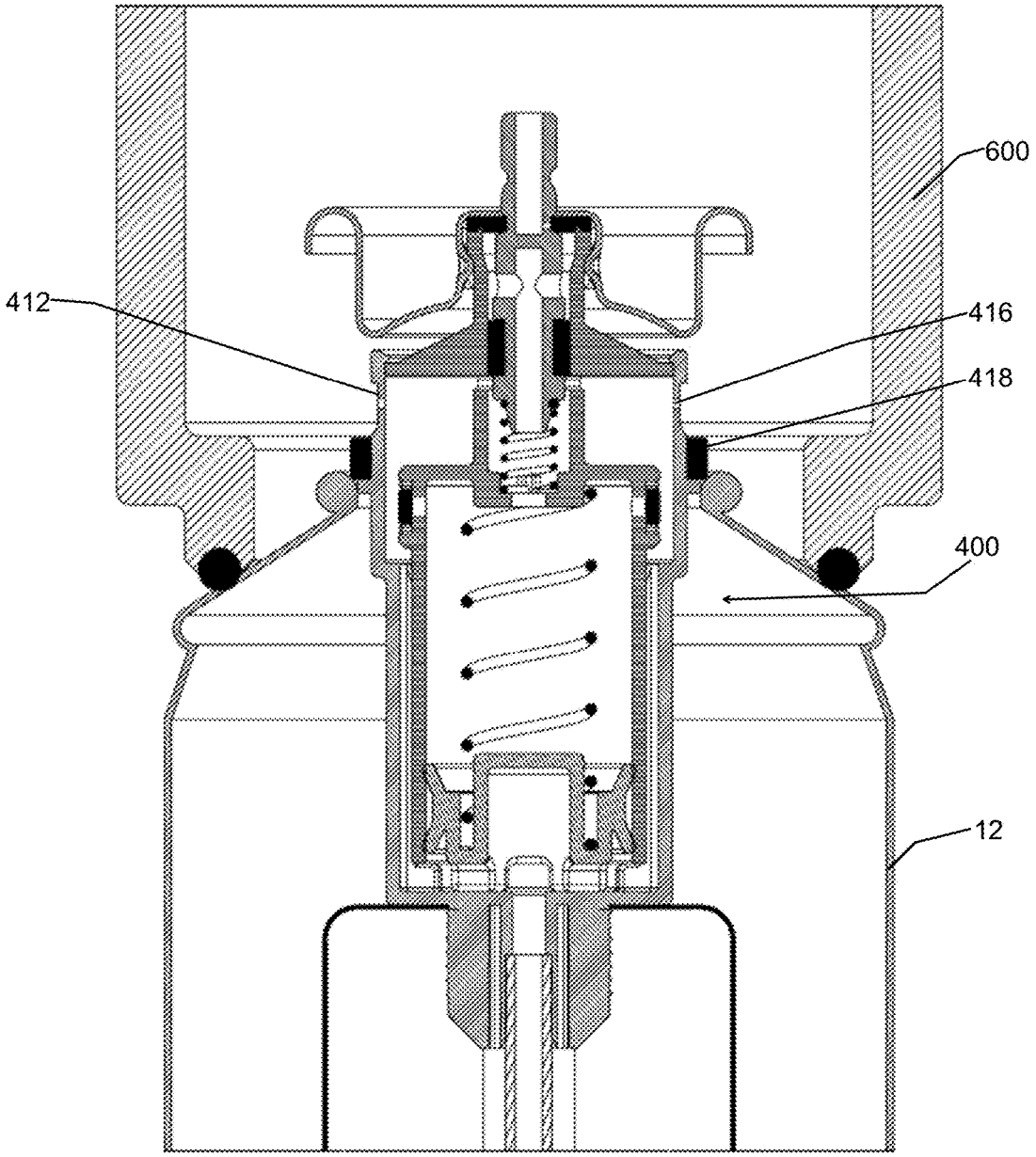

FIG. 20 is a cross sectional view of the metered valve assembly of FIG. 17 after vacuuming.

Figure 21:
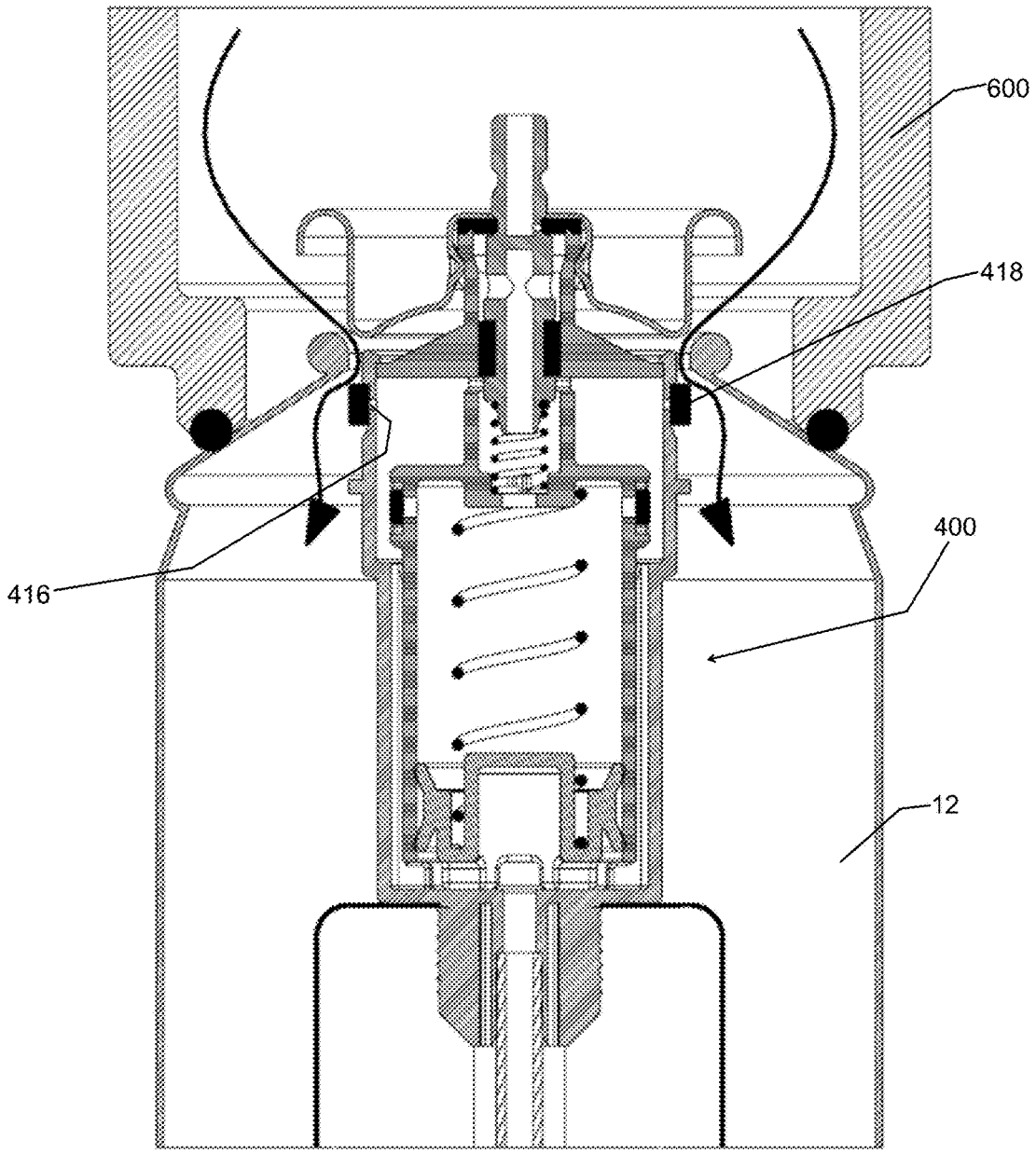

FIG. 21 is a cross sectional view of the metered valve assembly of FIG. 17 being filled with air pressure.

Figure 22:
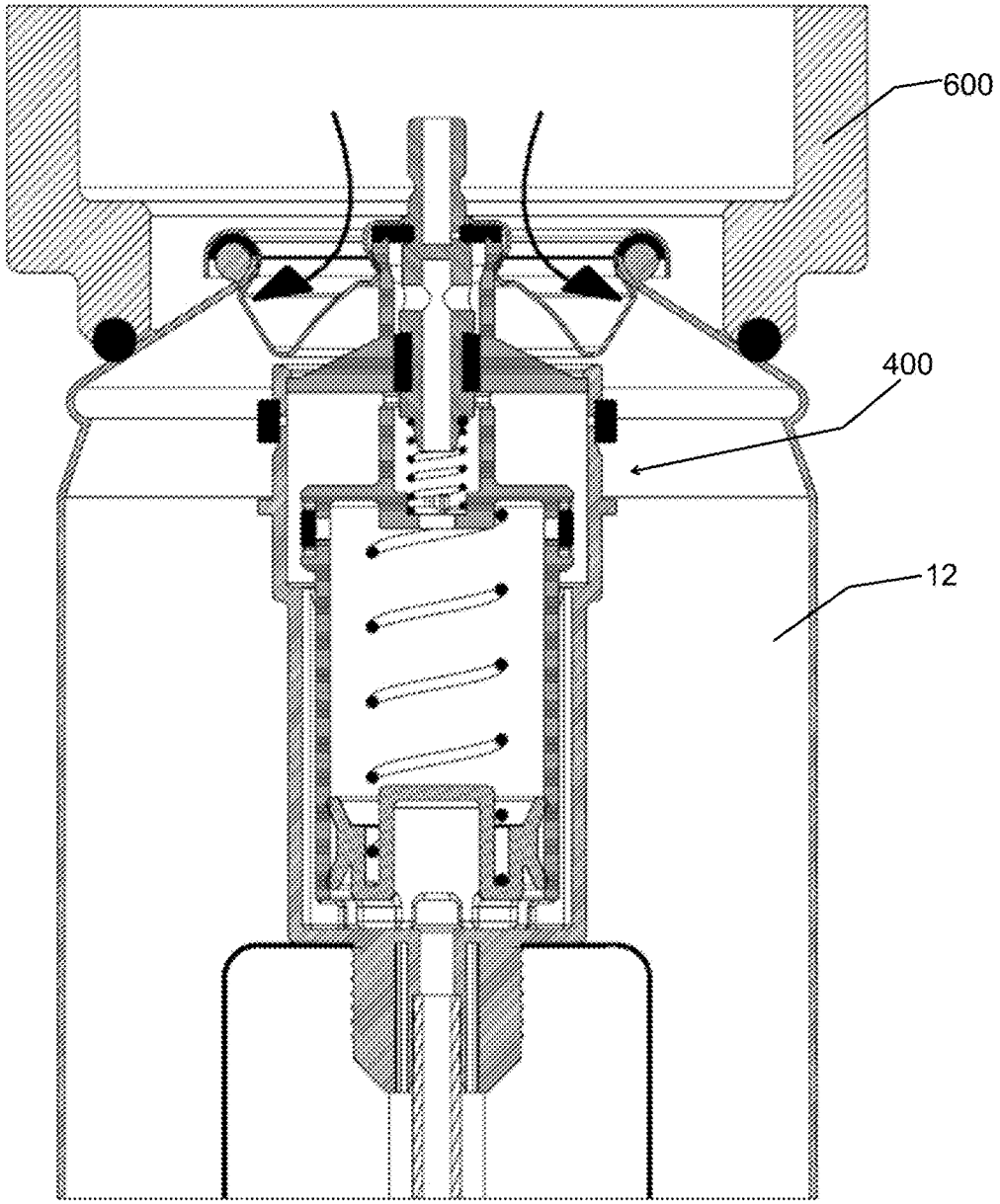

FIG. 22 is a cross sectional view of the metered valve assembly of FIG. 17 being cinched to the container.

Figure 23:
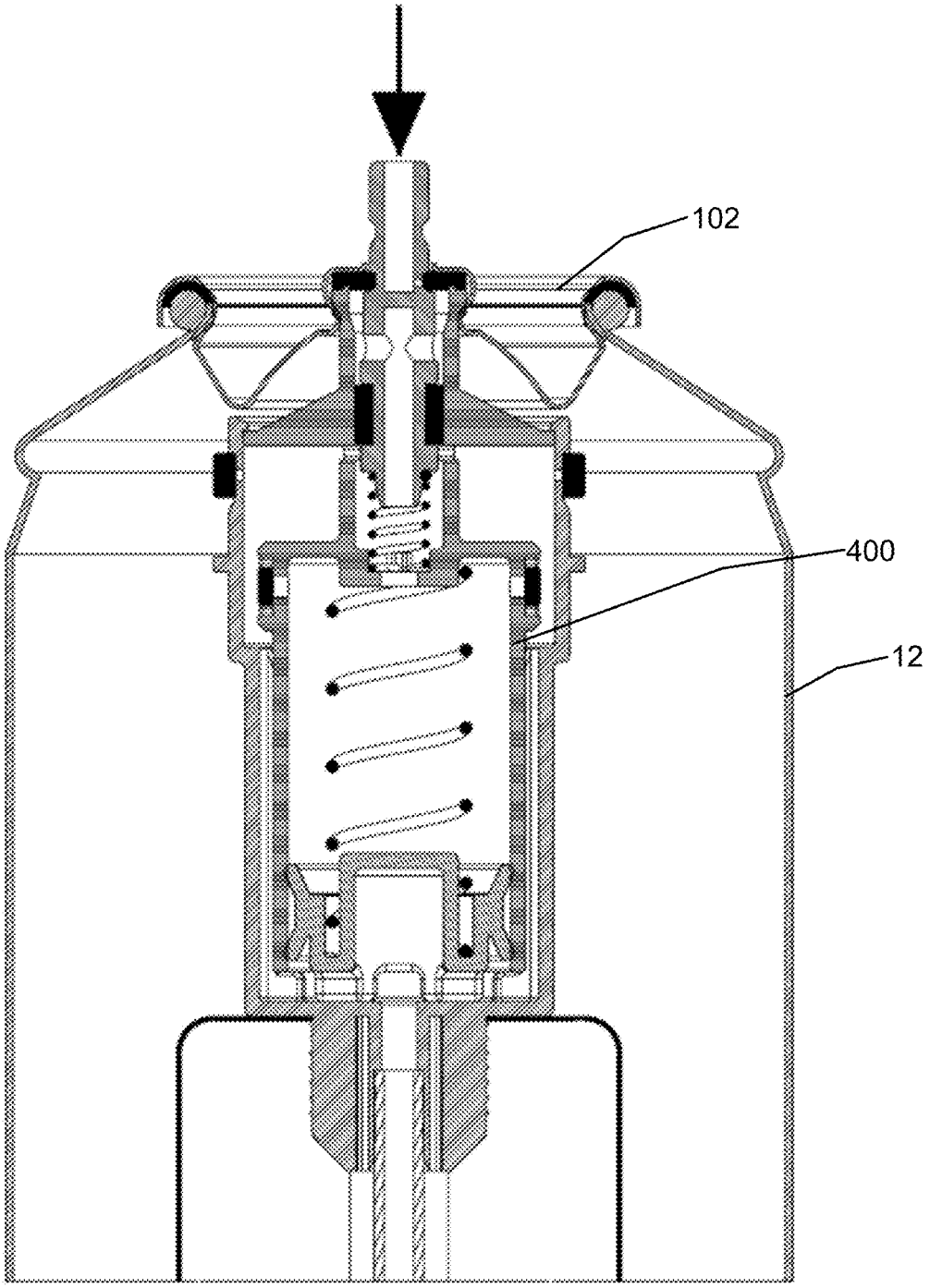

FIG. 23 is a cross sectional view of the metered valve assembly of FIG. 17 having product transferred into a container.

Figure 24:
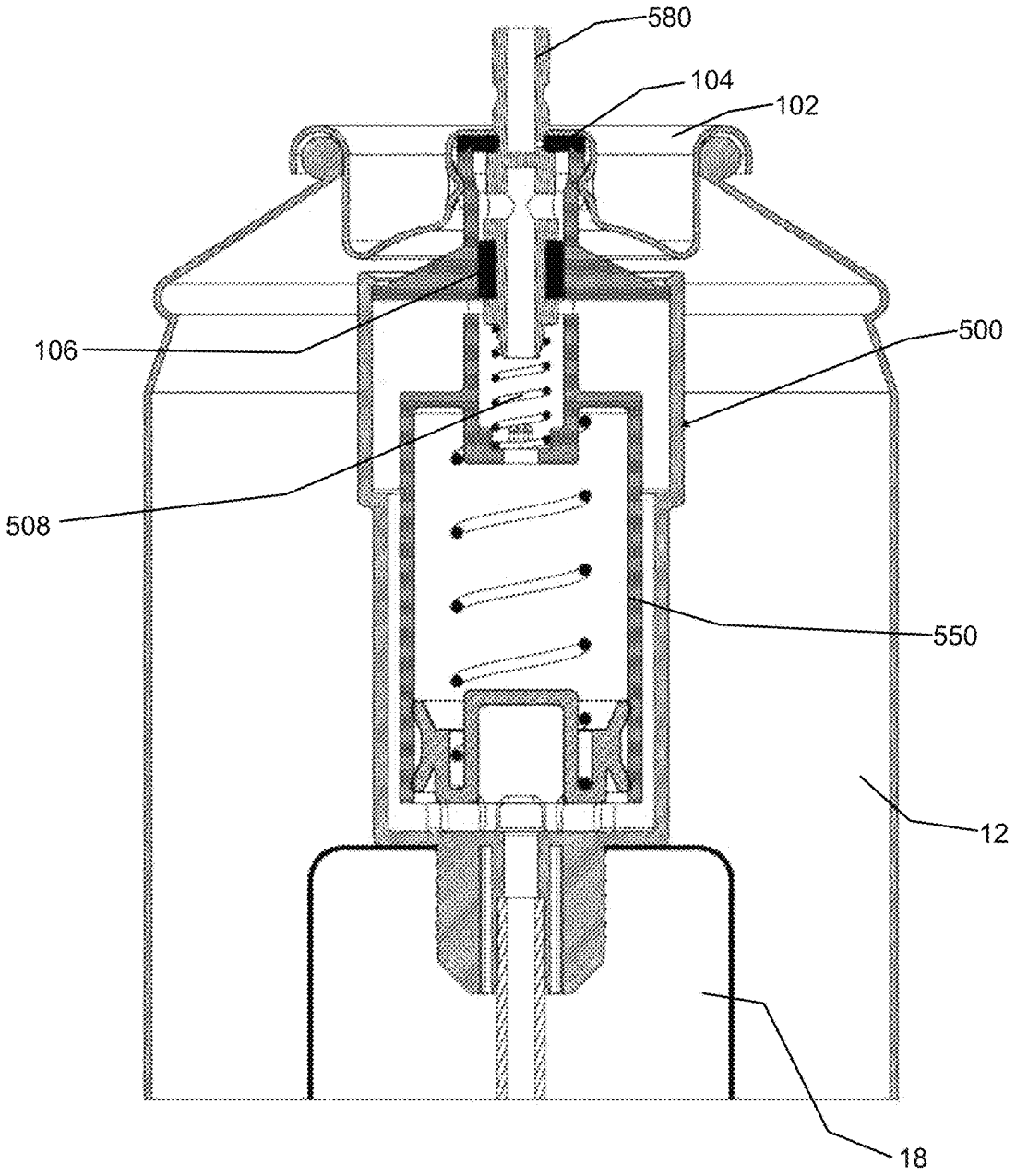

FIG. 24 is yet another alternative embodiment of a metered valve assembly according to the present disclosure and in an unactuated state.

Figure 25:
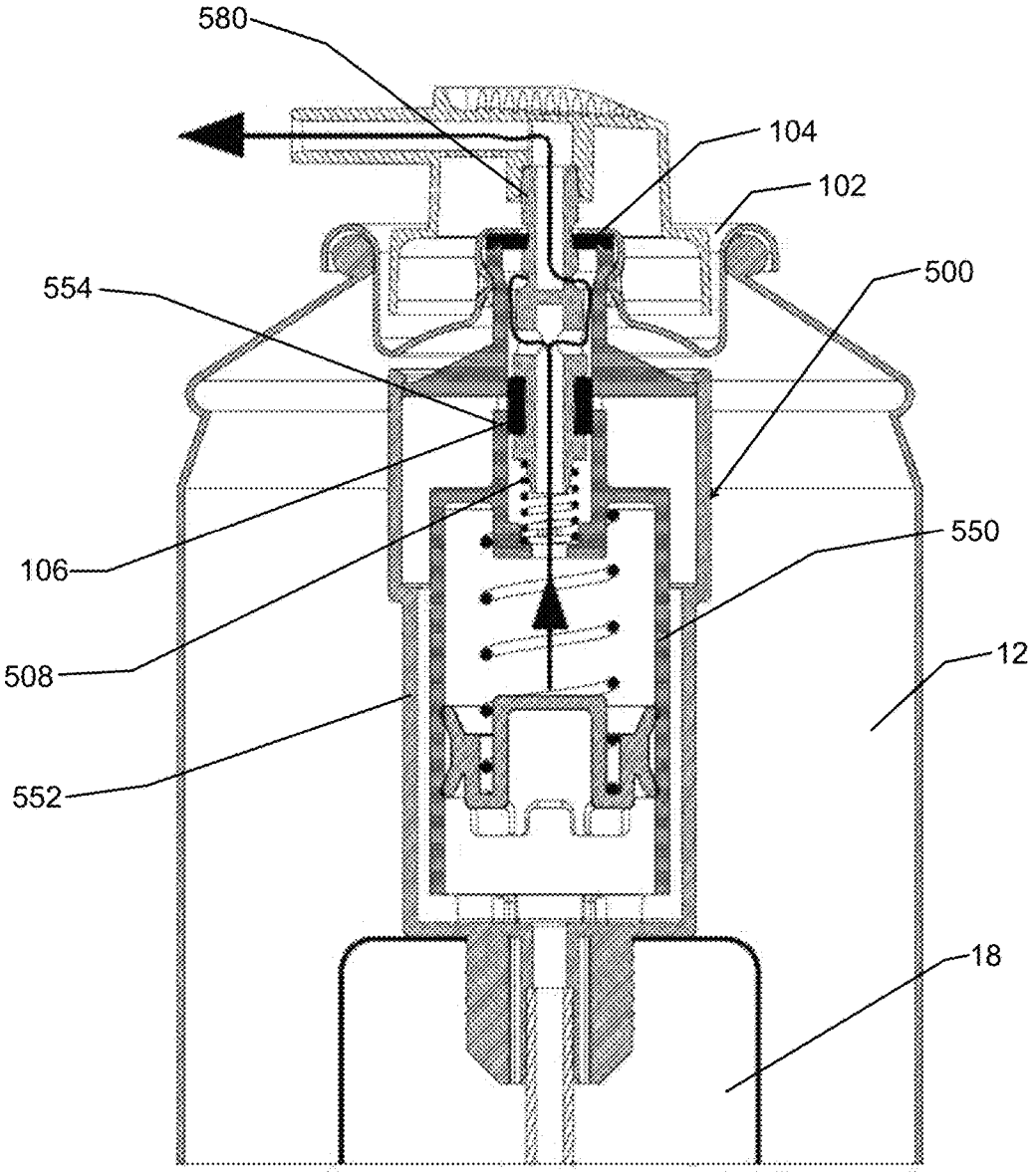

FIG. 25 is a cross sectional view of the metered valve assembly of FIG. 24 shown in a first dispensing state that is metered.

Figure 26:
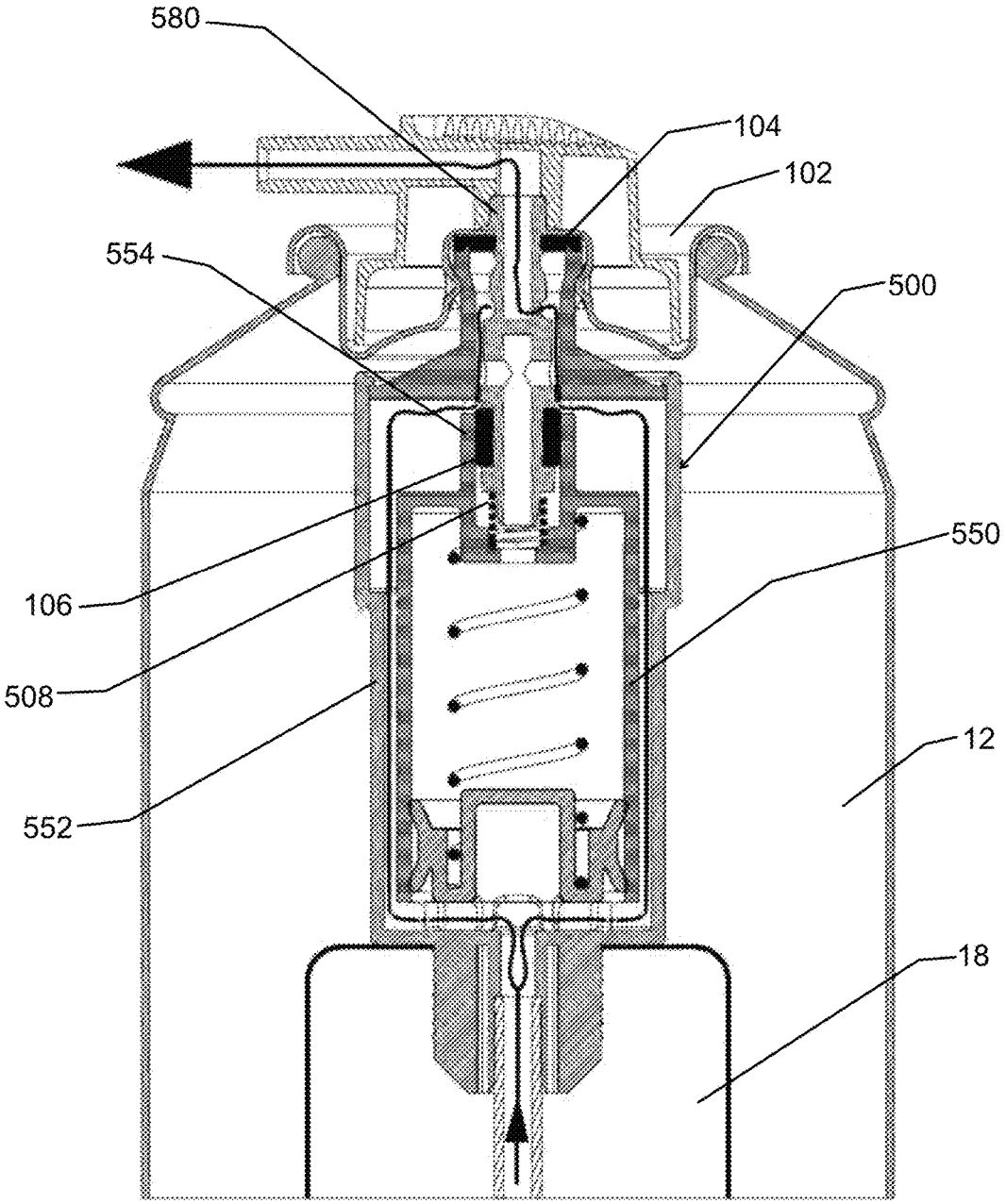

FIG. 26 is a cross sectional view of the metered valve assembly of FIG. 24 shown in a second dispensing state that is not metered with product being dispensed from the container.

Figure 27:
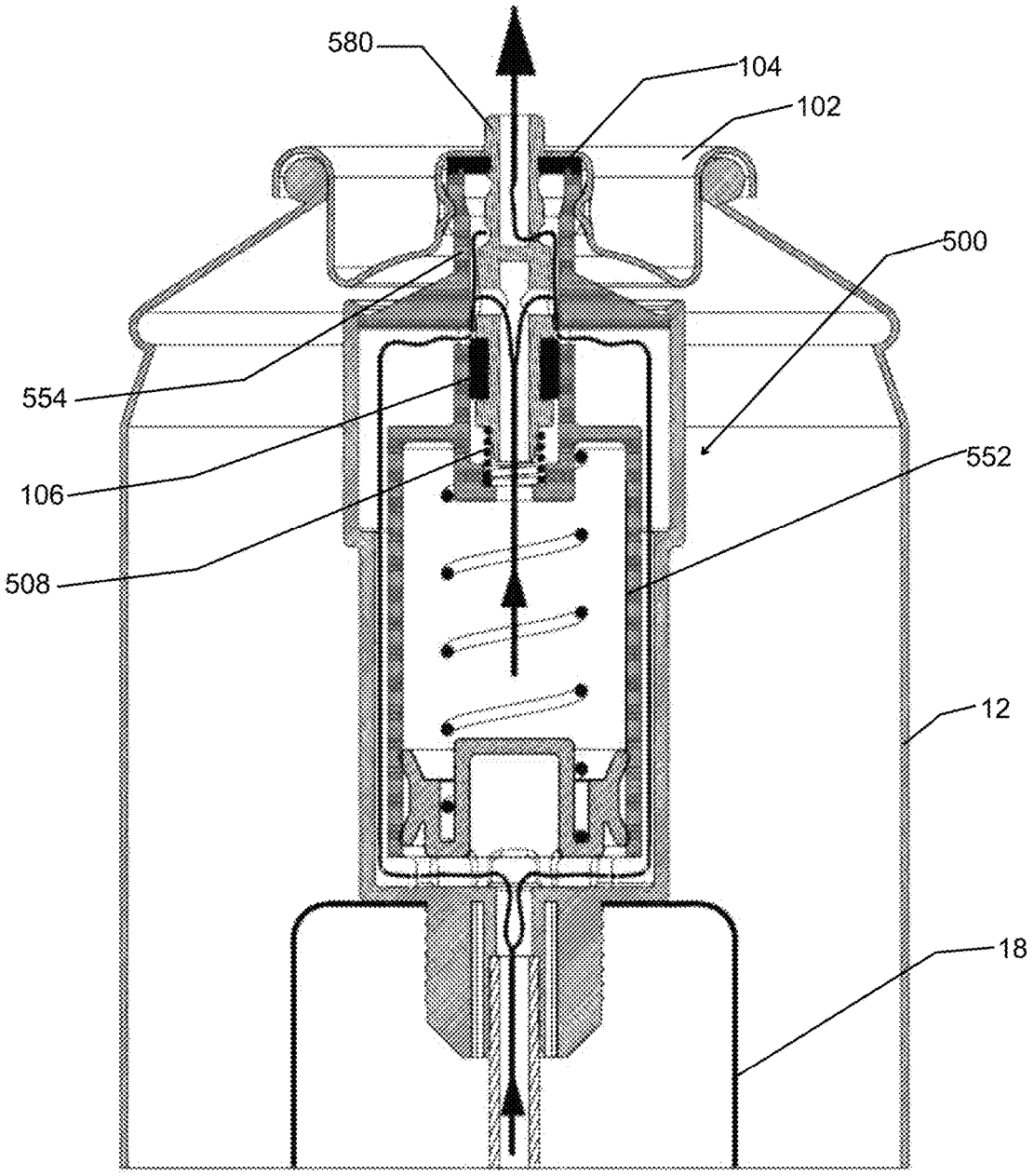

FIG. 27 is a cross sectional view of the metered valve assembly of FIG. 24 in the second dispensing state with the container being vacuumed during the filling process.

Figure 28:
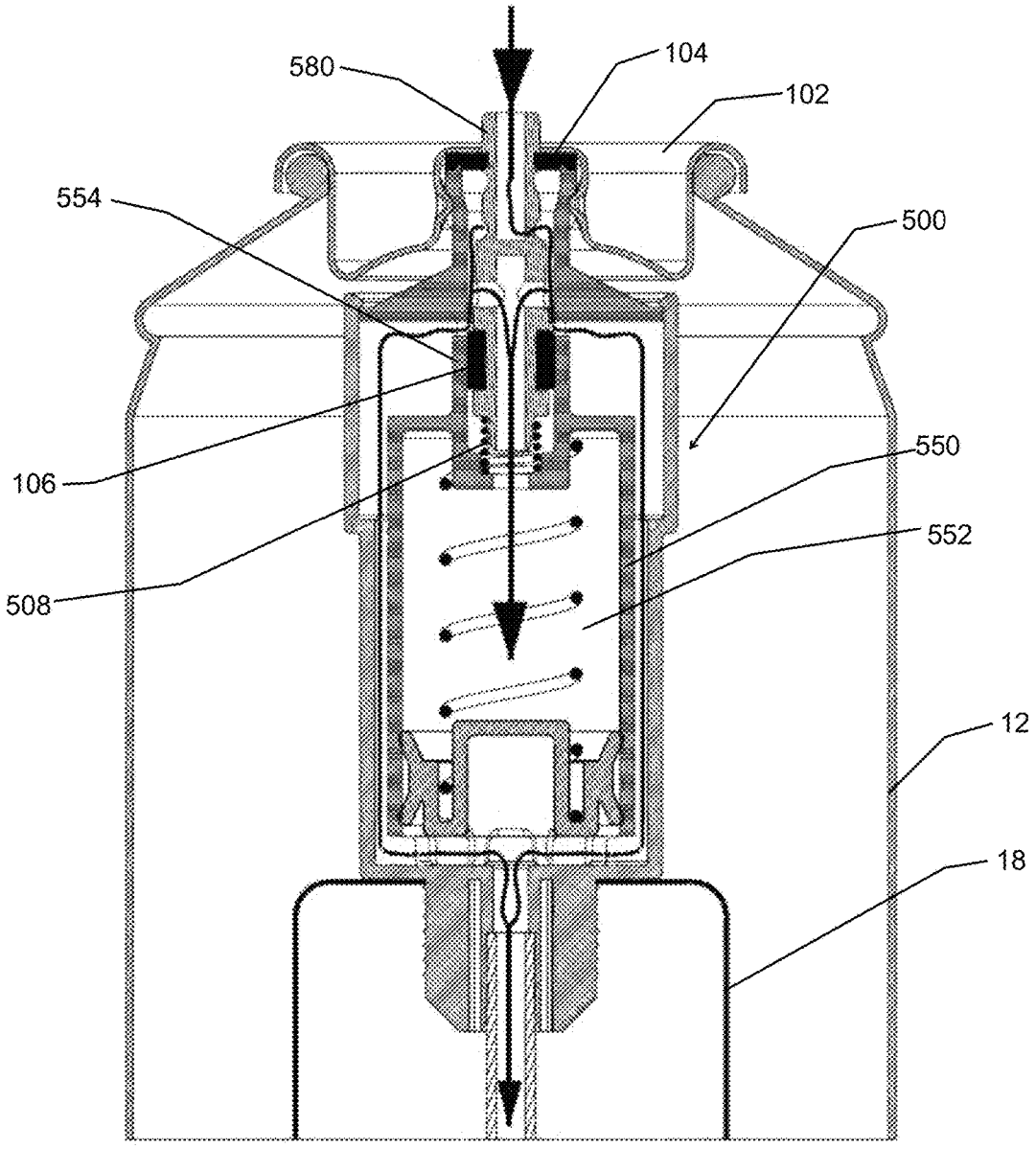

FIG. 28 is a cross sectional view of the metered valve assembly of FIG. 24 in the second dispensing state with the container being filled.

Figure 29:
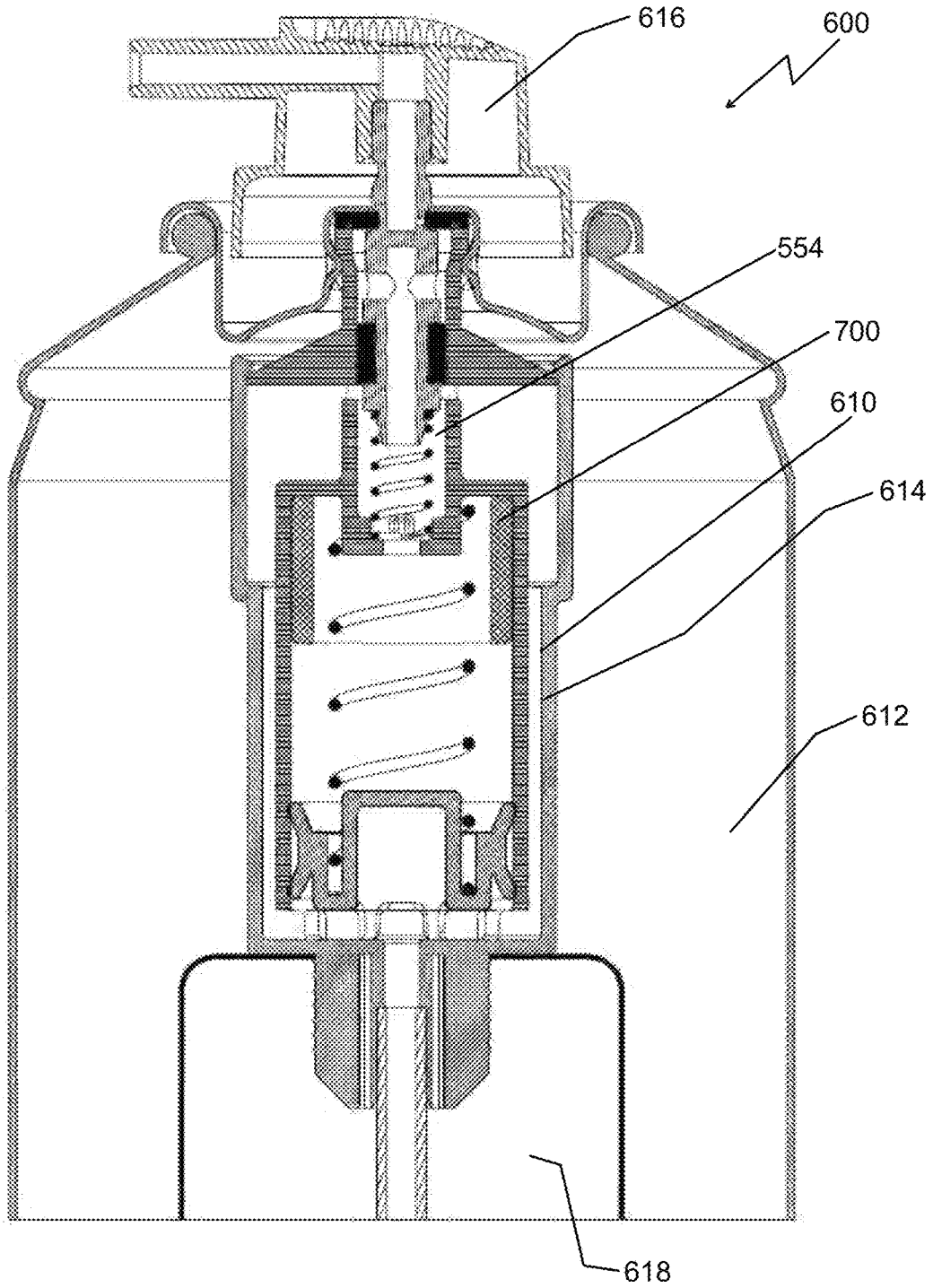

FIG. 29 is a cross sectional view of still yet another embodiment of the metered valve assembly that includes a spacer.

Figure 30:
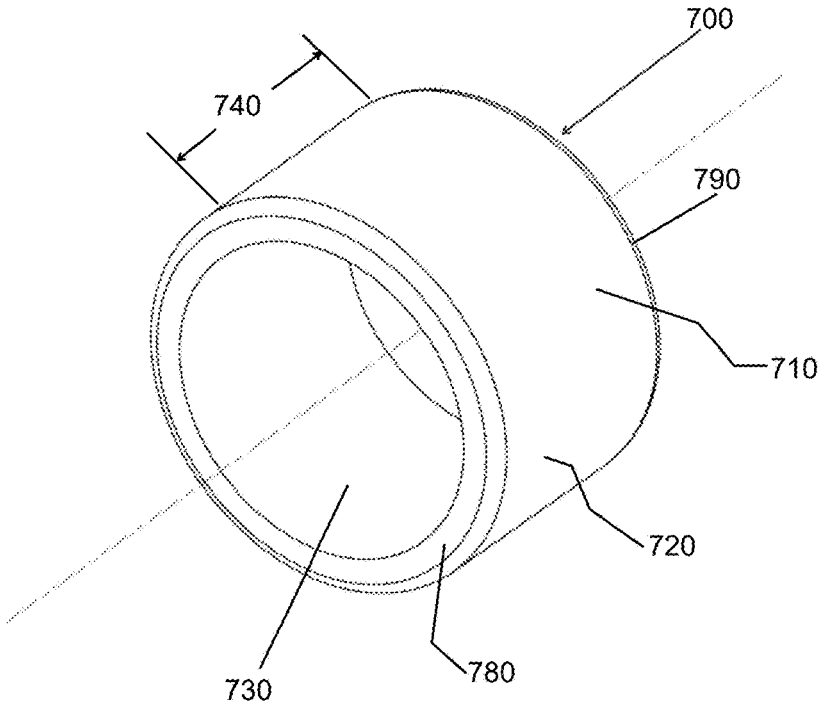

FIG. 30 is a perspective view of the spacer or spacer element.

Figure 31:
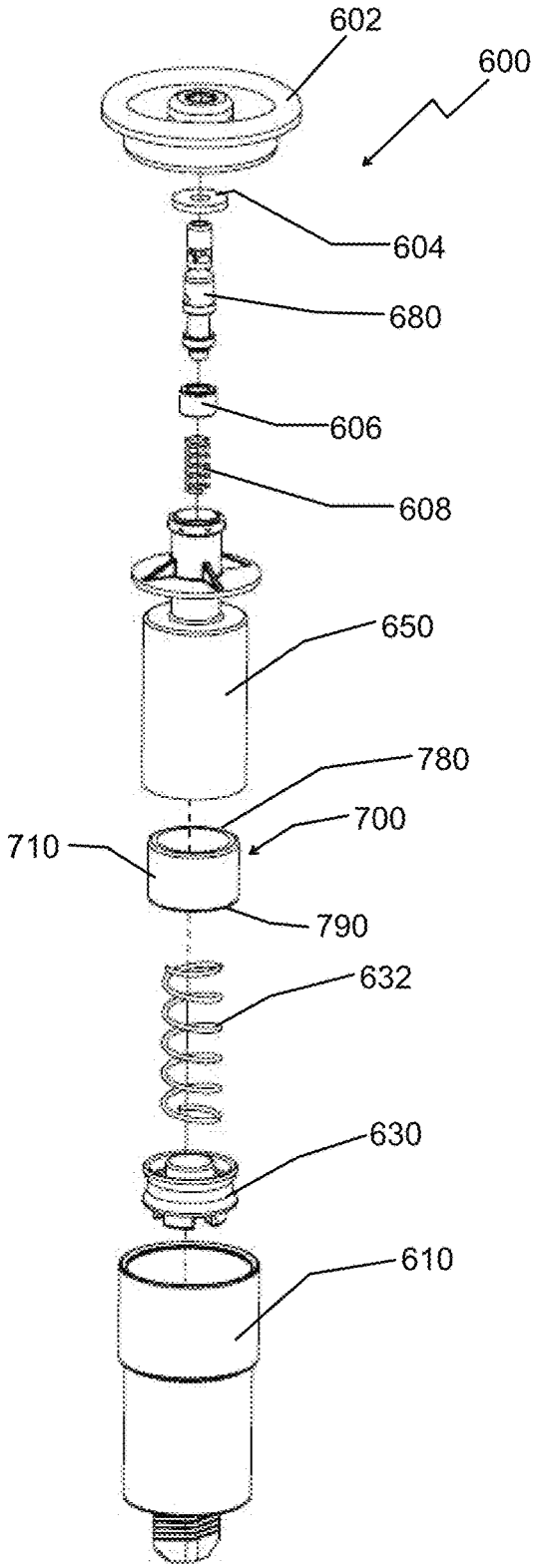

FIG. 31 is a perspective view of the metered valve of FIG. 29 with exploded view of the metered valve elements.

Figure 32:
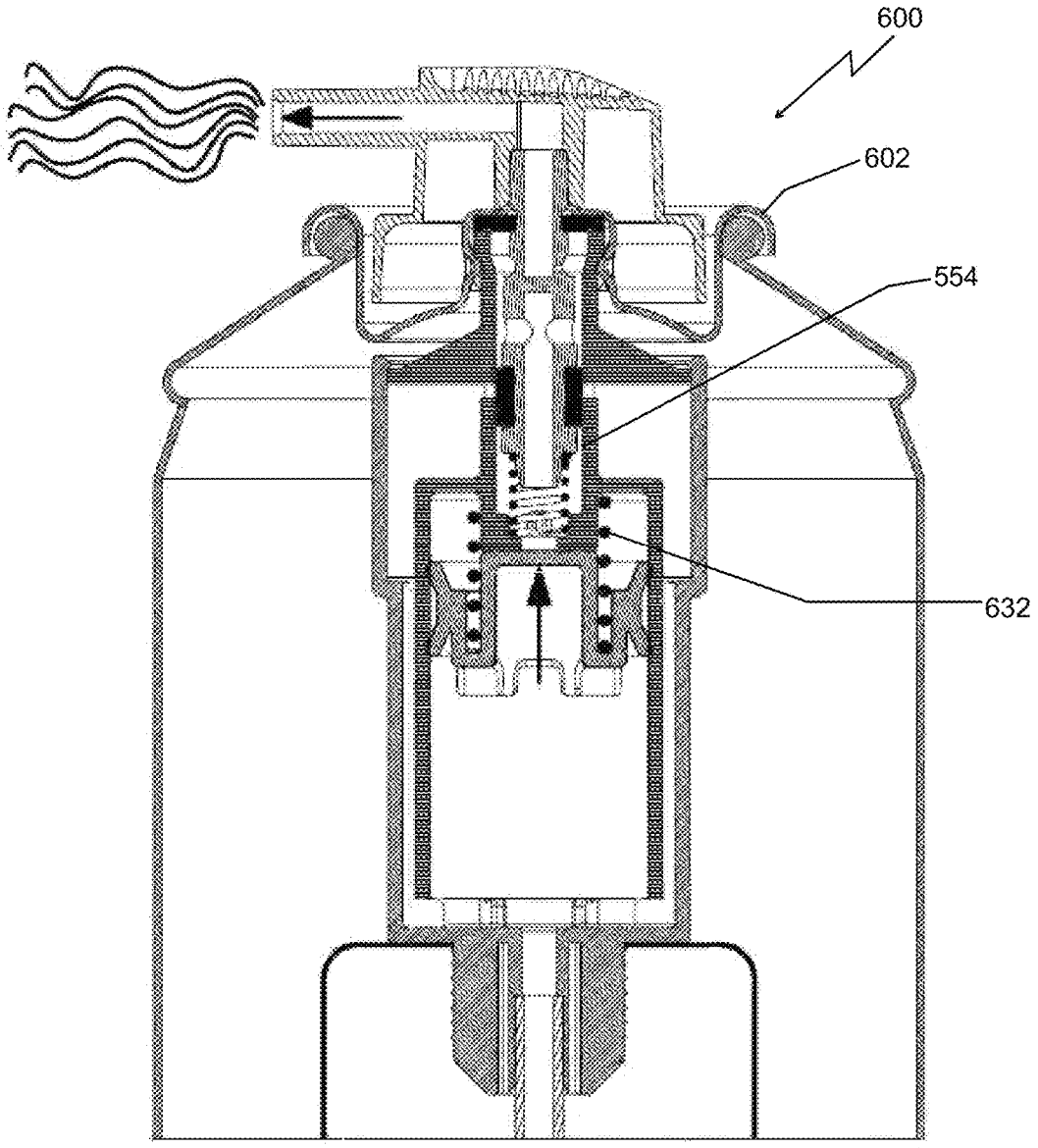

FIG. 32 is the valve at the end of a metered state but without the spacer.

Figure 33:
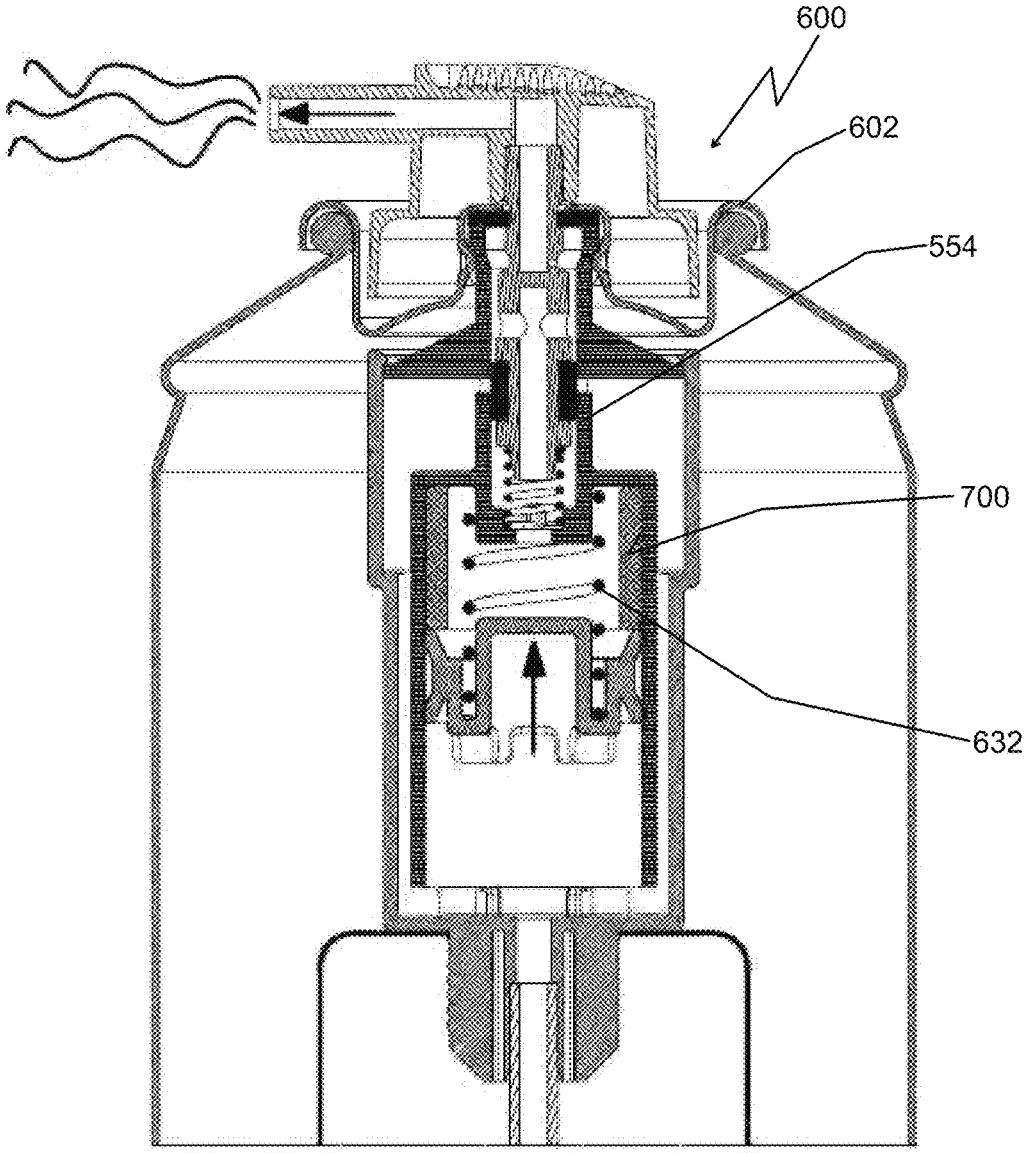

FIG. 33 is analogous to FIG. 32 with the valve at the end of the metered state and with the spacer.

The accompanying drawings illustrate presently preferred embodiments of the present disclosure directed to metered valves, and together with the general description given above and the detailed description given below, explain the principles of the present disclosure. As shown throughout the drawings, like reference numerals designate like or corresponding parts.

DETAILED DESCRIPTION OF THE DISCLOSURE

Figure 1:
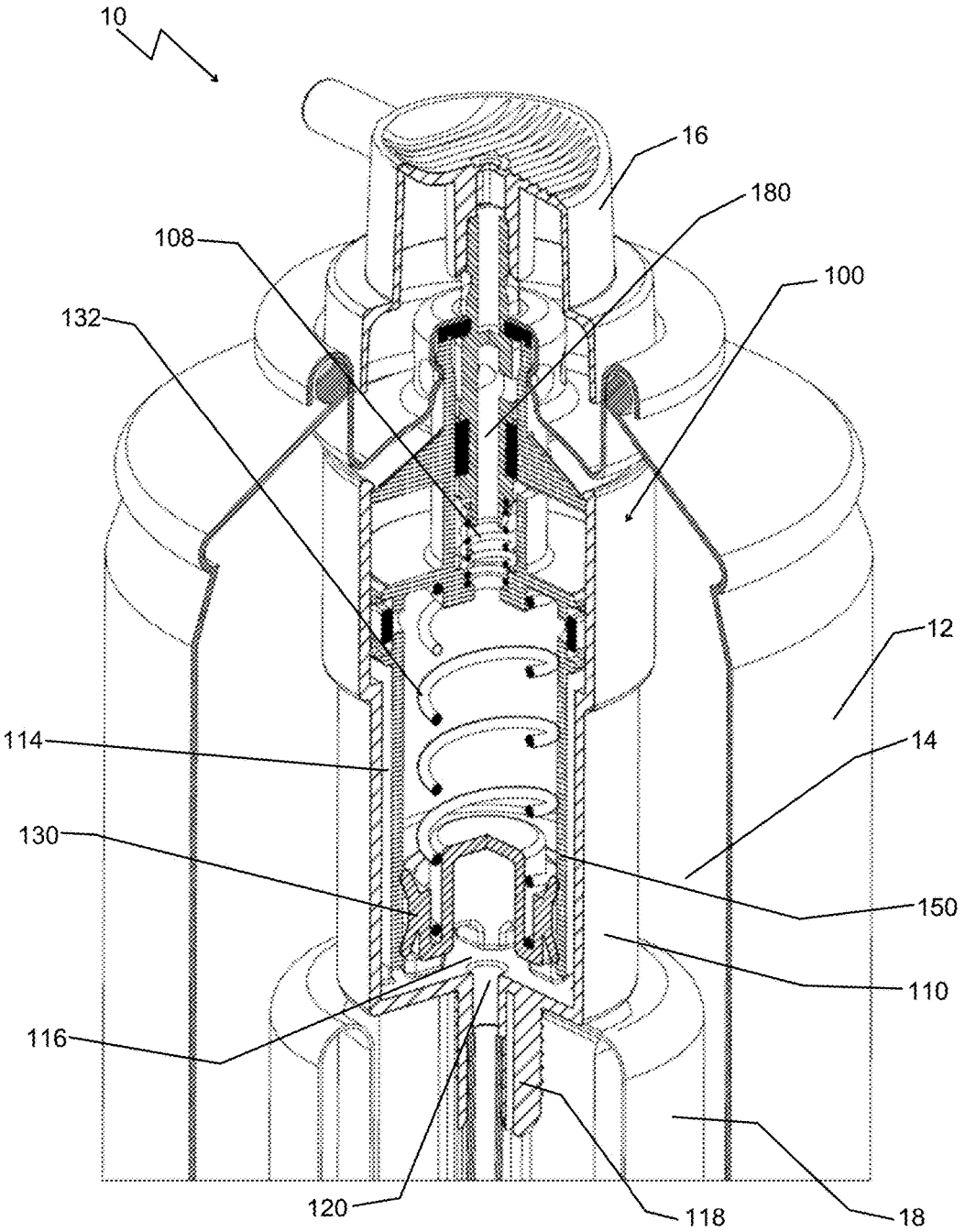
FIG. 1 is a perspective partial cutaway view of a device having a metered valve assembly for dispensing metered doses of product according to the present disclosure.

Referring to the drawings and, in particular, to FIG. 1, there is provided a device generally represented by reference numeral 10. Device 10 has a container 12, a spray cap or actuator 16, and a valve assembly for dispensing metered doses of product according to the present disclosure, which valve assembly or metered valve is generally represented by reference numeral 100.

Container 12 can be, but is not limited to, a can, canister, or any suitable receptacle for holding a product to be dispensed from. Container 12 has an inner volume 14.

Spray cap or actuator 16 operates device 10 to controls a spray rate of dispensed product. In bag-on-valve (BOV) embodiments, device 10 further has a bag 18 with product therein to be dispensed.

Figure 2:
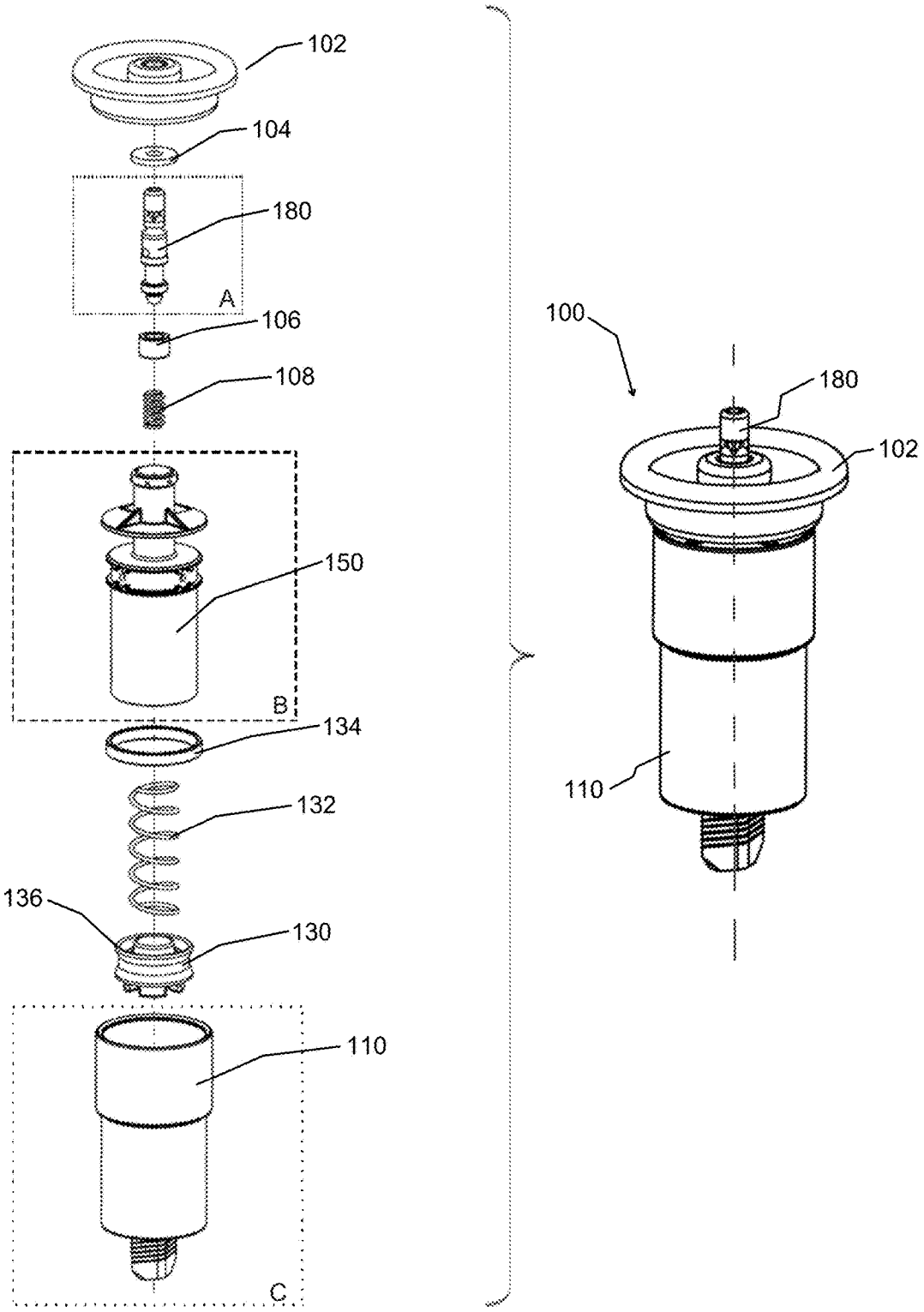
FIG. 2 is a perspective view of the metered valve of the device of FIG. 1 with exploded view of the metered valve elements.

Referring to FIG. 2, elements of metered valve 100 itself are more clearly shown. These elements include, in order as shown from top to bottom, cup 102, stem gasket 104, valve stem 180, selector gasket 106, stem spring 108, dosing structure or body 150, gasket ring 134, piston spring 132, piston 130 and valve housing 110. Valve housing 110 is a shell for the dosing chamber structure or body 150 that serves to provide a metered dose of product.

Figure 3A:
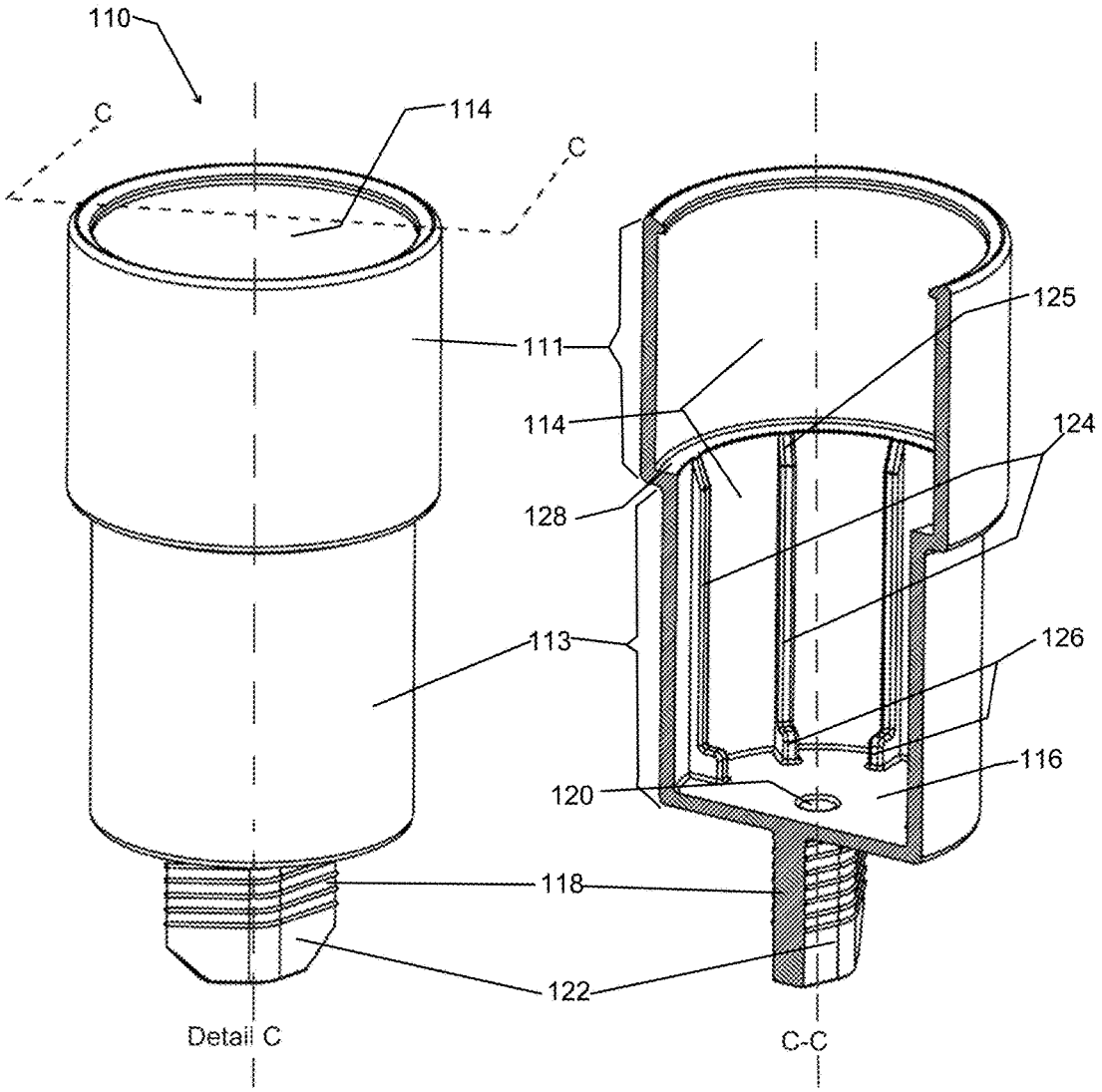
FIG. 3A is a perspective and cross section view of a housing for the metered valve of FIG. 1.

Referring to FIG. 3A, valve housing 110 is a generally cylindrical shell with an inner surface 114 about a circumference thereof. However, valve housing 110 can have other shapes, such as for example, oblong, hexagonal, rectangular, and the like. Valve housing 110 receives dosing chamber structure 150 so that dosing chamber structure 150 is positioned in a lower portion 113 of valve housing 110. As shown, an upper portion 111 of valve housing 110 has a larger diameter than lower portion 113. Valve housing 110 has a base 116. Depending from a bottom of base 116 is a tailpiece 118. A dip tube (not shown) attaches to tailpiece 118 and extends into container 12. Base 116 and tailpiece 118 have a bore 120 therethrough that provides fluid communication with an inner volume of valve housing 110. In the BOV embodiments, tailpiece 118 provides a surface area 122 around which a bag is welded.

In the preferred embodiments of the present disclosure, three or more substantially, and preferably completely, vertically disposed ribs 124 project radially from inner surface 114 by a rib depth. Ribs 124 extend vertically from base 116 to an annular ledge 128 that separates upper portion 111 and lower portion 113. Annular ledge provides for different internal circumferences of upper portion 111 and lower portion 113.

Figure 3B:
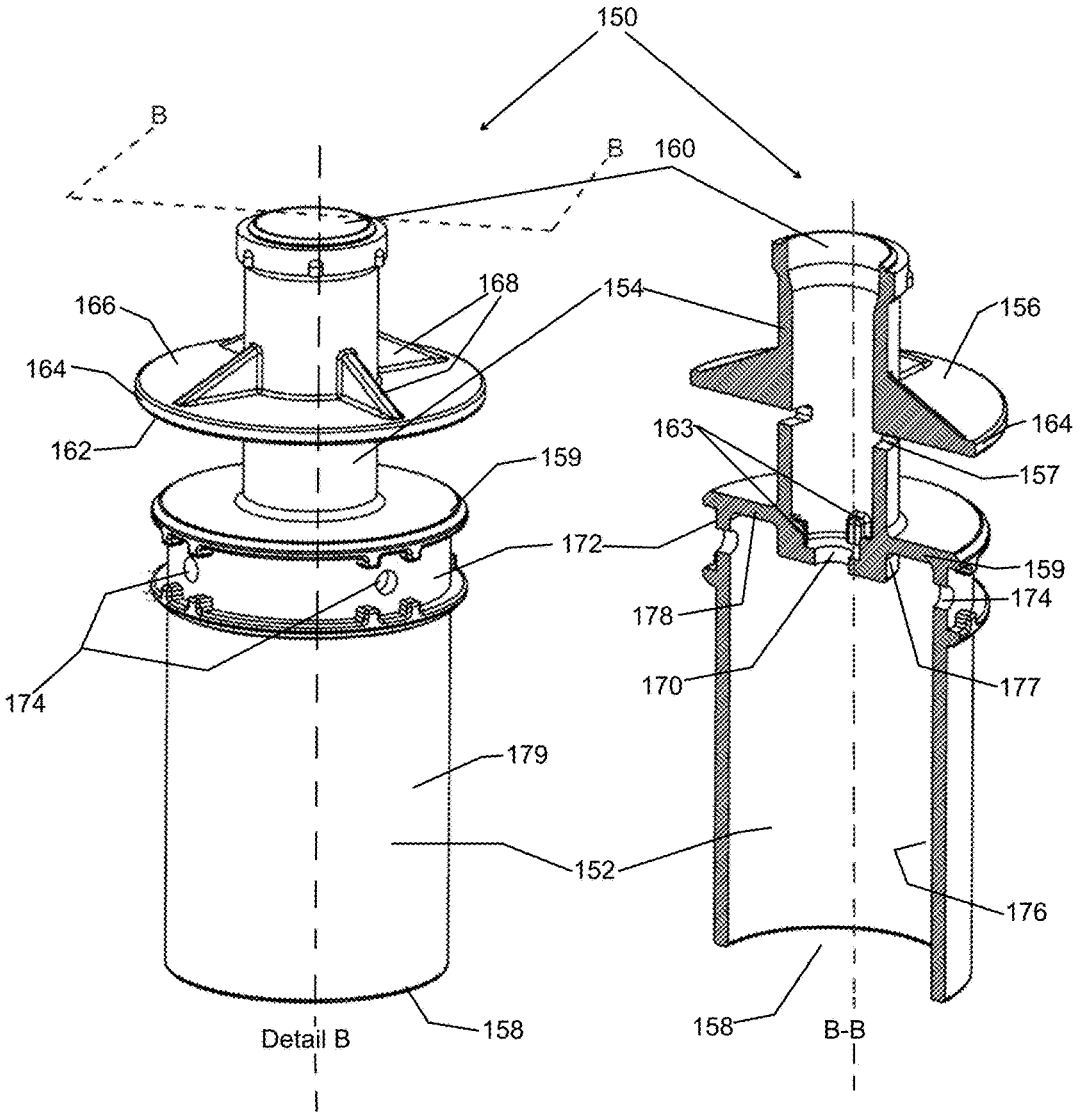
FIG. 3B is a perspective and cross section view of a dosing structure body for the metered valve of FIG. 1.

Ribs 124 serve to maintain a virtually vertical or an axial alignment of body 150 shown in FIG. 3B, the dosing structure in valve housing 110. Stated another way, ribs 124 keep body 150 concentric to valve housing 110. Ribs 124 further maintain separation by a distance or the rib depth between the outer surface of dosing chamber structure 150 and inner surface 114, thereby resulting in vertically oriented channels through which product can flow therebetween.

There can be three, four, five, six, seven, eight, or more ribs 124. Preferably, ribs 124 are equally spaced about inner surface 114 of valve housing 110.

Referring to FIG. 3A, ribs 124 can also have a feature 125 to guide dosing chamber structure 150 during insertion into valve housing 110. Feature 125 can be, for example, an inward slanted surface at an upper end as shown.

Ribs 124 preferably include feet 126 that project from base 116. With this configuration, feet 126 support a planar surface, such as the base of dosing structure or body 150 of FIG. 2, so that the planar surface is vertically displaced from base 116 by the depth of the feet. This structure creates a plurality of channels below dosing chamber structure 150 through which product can flow. In some embodiments, the feet depth and rib depth are the same. In other embodiments, the feet depth is greater than the rib depth. In still other embodiments, feet depth is less than rib depth. Ribs 124 and feet 126 serve to maintain free flowing channels in metered valve 100.

Referring to FIGS. 2 and 3B, dosing chamber structure 150 is disposed in valve housing 110. Dosing chamber structure 150 has a lower portion or dose chamber 152 and an upper portion or stem tunnel 154. Dosing chamber structure 150 has a central axis with a bore 170 that communicates between an inner volume of dose chamber 152 and stem tunnel 154.

Referring to FIG. 3B, dose chamber 152 is a hollow cylindrical body with an open bottom end 158 and a closed top end 159. Closed top end 159 has an upper surface 178 in the cylindrical body at a top end thereof. An inner annular surface of the cylindrical body is inner surface 176. An annular outer surface of dose chamber 152 is surface 179. Adjacent to top end 159, dose chamber 152 has an annular groove 172 around an outer circumference thereof. Annular groove 172 is sized to receive gasket ring 134 of FIG. 2. In the embodiment shown, annular groove 172 is formed between two disc members having an outer diameter greater than an outer diameter of surface 179. At least one aperture 174 is disposed in annular groove 172 and through the body of dose chamber 152. Preferably, in embodiments with two or more apertures, each adjacent pair of apertures 174 is equally spaced apart. Alternatively, apertures 174 are equally sized, or both equally sized and equally spaced about the circumference.

Referring to FIG. 3B, stem tunnel 154 projects vertically from top end 159. Stem tunnel 154 is a hollow cylindrical body with an open top end 160. Fluid communication between dose chamber 152 and stem tunnel 154 is by bore 170 through a central axis of body 150. Stem tunnel 154 is sized to receive valve stem 180. Further, stem tunnel has an outer diameter that is less than an outer diameter of dose chamber 152. Stem tunnel 154 has a disc member 156 that is horizontally disposed around an outer circumference thereof. Below disc member 156 is at least one aperture 157 through the cylindrical body of stem tunnel 154. Disc member 156 provides a top to valve housing 110.

Disc member 156 has a top surface 166, bottom surface 162, and circumferential surface 164. Circumferential surface 164 is also a sealing surface to seal off valve housing 110. A plurality of triangular ribs 168 extend from the outer surface of stem tunnel 154 and along top surface 166 to circumferential surface 164. These triangular ribs 168 provide strength and maintain disc member preferably perpendicular, or at least substantially perpendicular, to a central axis of metered valve 100.

Referring again to FIG. 2, piston 130 and piston spring 132 are inserted axially in dose chamber 152 so that the piston spring 132 is supported between upper surface 178 and piston 130.

Piston 130 has an annular outer surface 136 that creates a fluid tight or substantially fluid tight friction seal against inner surface 176 of dose chamber 152. In this way, piston 130 seals dose chamber 152. Piston 130 is supported by a pedestal 131 and is axially displaceable so that when the piston moves up and down, this movement results in an increasing and decreasing, respectively, of dose chamber 152 volume. Grooves through a bottom surface of pedestal 131 form channels 133 and 135 that product can flow through when piston 130 rests on base 116.

Piston spring 132 is preferably a coil spring that is biased against piston 130 and thus urges the piston 130 away from upper surface 178.

A gasket ring 134 is seated in annular groove 172 and is sized to cover aperture(s) 174. With this configuration, gasket ring 134 provides a fluid/liquid tight seal between annular groove 172 and aperture(s) 174. As noted below, gasket ring 134 also serves as a one-way valve when filling container 12.

Surface 178 has depending therefrom a protrusion 177 that provides a seat to retain piston spring 132 in axial alignment. Preferably, protrusion 177 is cylindrical. Preferably, spring 132 has a diameter larger than the protrusion 177 so that the spring circumscribes the protrusion. Also, preferably, piston spring 132 is press fit around the protrusion.

Figure 5A:
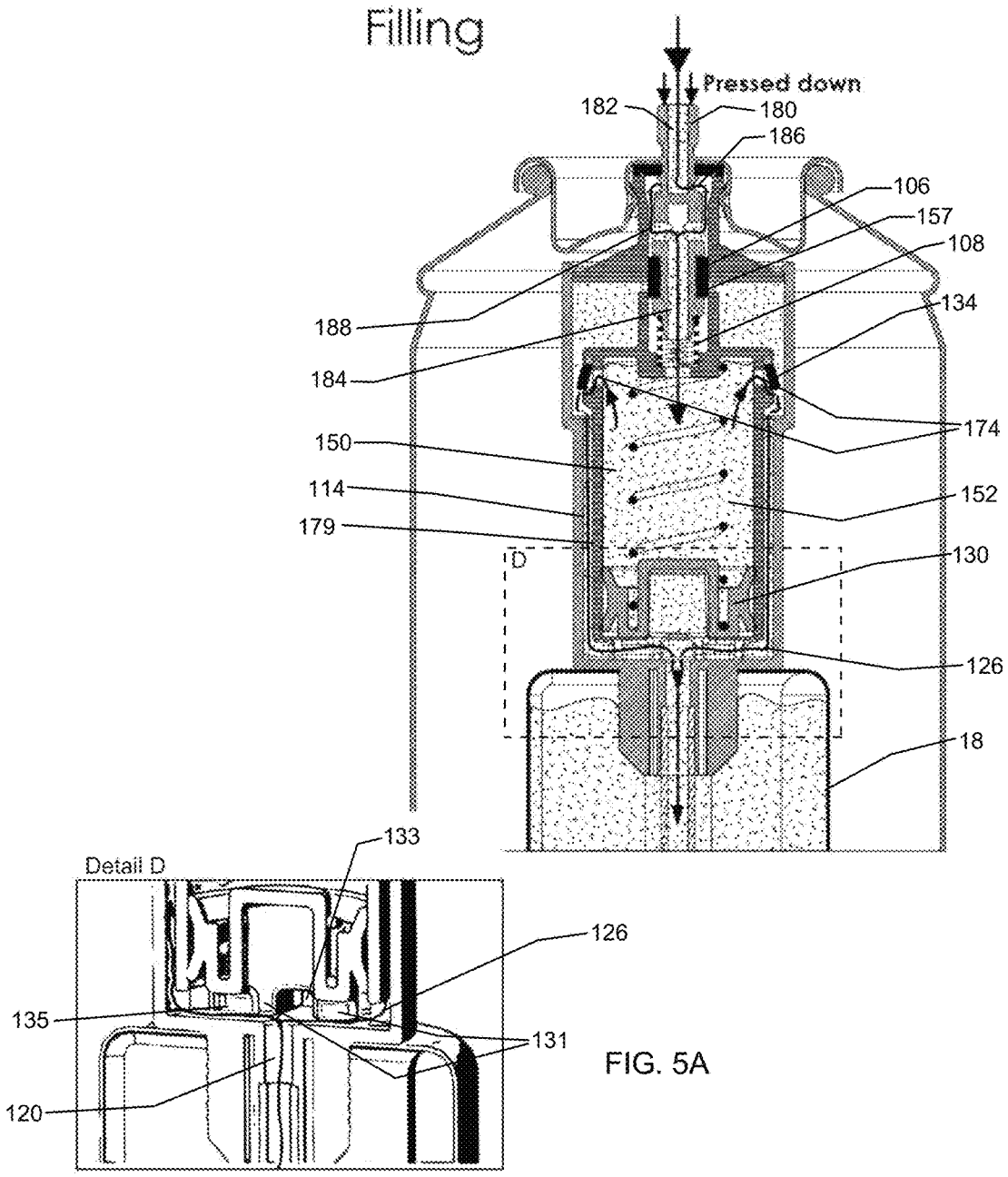
FIG. 5A is a cross sectional view of the device of FIG. 1 shown in a state of being filled.

As discussed above, dose chamber structure 150 that includes dose chamber 152 is supported in valve housing 110 by feet 126 and ribs 124. As shown in FIG. 5A, the features of feet 126 and ribs 124 create clearance and channels, as shown in detail D, for product flow between surface 179 of dose chamber structure 150 and inner surface 114 of valve housing 110 as well as below dose chamber structure 150.

Referring again to FIG. 2, stem spring 108 is compression coil spring. Stem spring 108 is axially disposed in stem tunnel 154 of body 150 and supports valve stem 180. Stem spring 108 provides the internal force required to return valve stem 180 to a closed position after actuation. Preferably, stem tunnel 154 has a plurality of feet 163 disposed at a bottom end. Feet 163 are disposed about a central axis to create a seat that supports stem gasket 104.

Figure 3C:
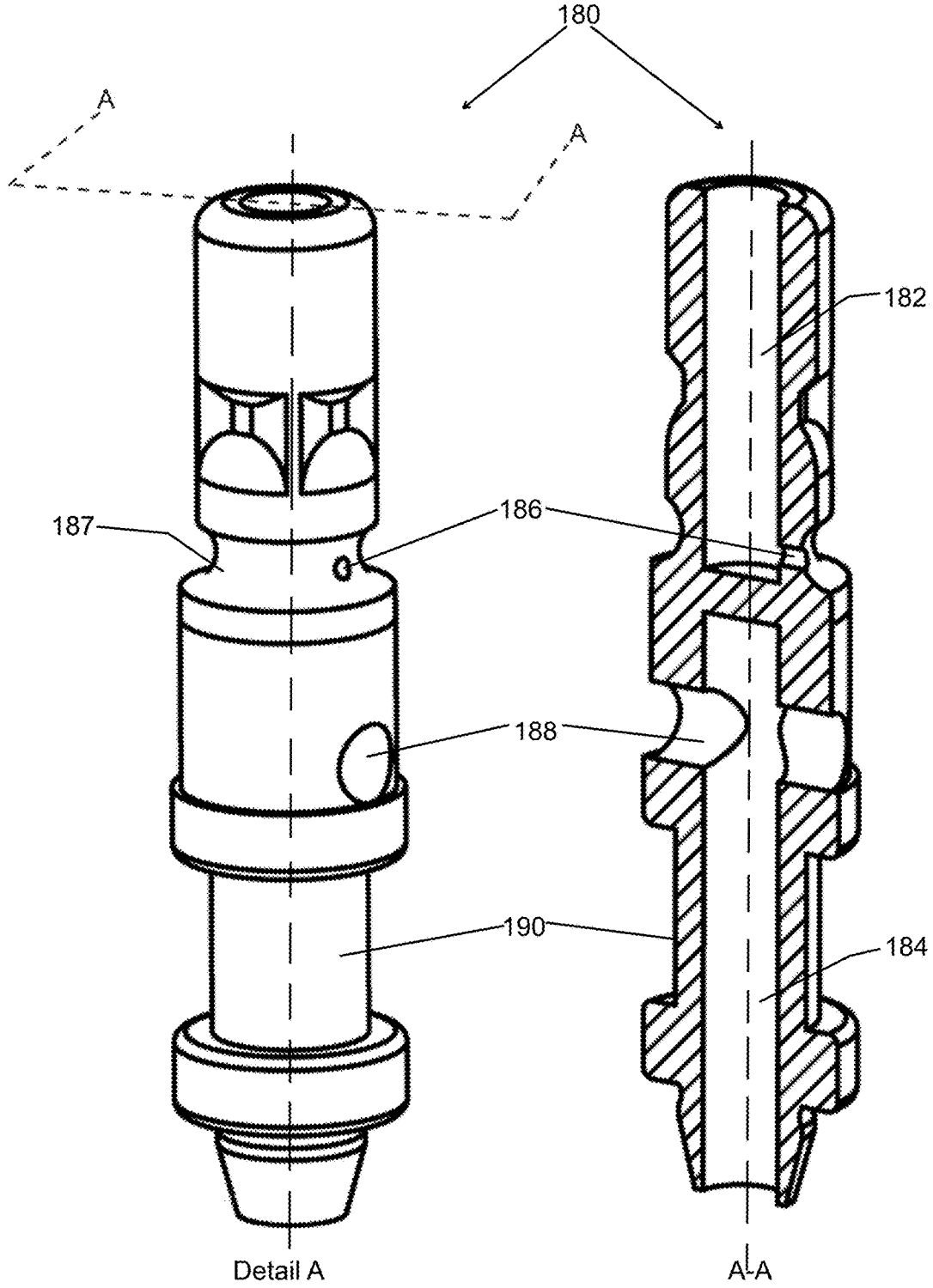
FIG. 3C is a perspective and cross section view of a valve stem for the metered valve of FIG. 1.

Referring to FIG. 3C, valve stem 180 is a cylindrical body that has a hollow, upper chamber 182 and a hollow, lower chamber 184. Upper chamber 182 has at least one aperture 186 disposed radially through the body. Preferably, aperture 186 is recessed in a neck portion 187 of valve stem 180 that receives stem gasket 104. Still preferably, aperture 186 is at least two apertures on opposing sides of valve stem 180, or even three or more apertures equally spaced about a diameter of the valve stem. For high viscosity products, a larger cross sectional area of aperture 186 facilitates filling and dispensing of the product. Multiple apertures 186 allow for larger cross sectional product flow than a single aperture while at the same time using an equally sized gasket. Lower chamber 184 also has at least one aperture 188 disposed axially through the body of valve stem 180, and preferably at least two apertures on opposing sides. In certain embodiments, the at least two apertures, either apertures 186 or apertures 188, are three, four, or more apertures. Valve stem 180 moves axially in stem tunnel 154 and is biased against stem spring 108. Valve stem 180 has a circumferential groove 190 around an outer perimeter thereof. Circumferential groove 190 receives a selector gasket 106. By axial movement of valve stem 180, selector gasket 106 moves between a first or unactuated position that unseals and a second or actuated position that seals aperture 157.

Figure 4:
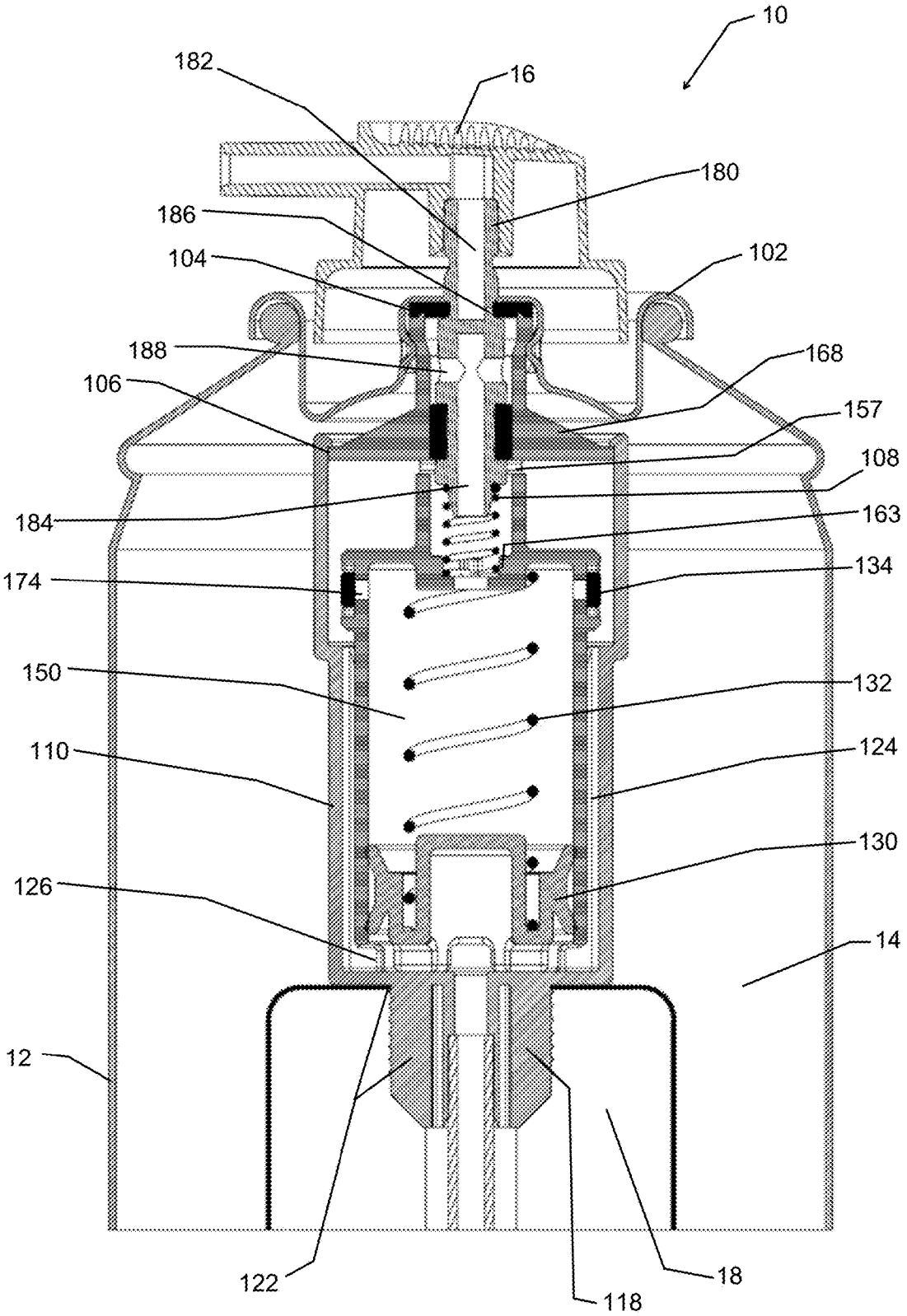
FIG. 4 is a cross sectional view of the device of FIG. 1.

Referring to FIG. 4, cup 102 mounts, orients, and seals metered valve 100 onto container 12. Optionally, cup 102 can have a gasket (not shown). Cup 102 also encloses a top end of a valve housing 110. Cup 102 has an aperture through which a portion of valve stem 180 projects. Cup 102 has an inner surface that overlaps stem gasket 104. Moreover, cup 102 serves to clamp valve stem 180, stem gasket 104, and dose chamber structure 150 together while at the same time providing a hermetic seal to container 12. Cup 102 also serves as an attachment platform for actuator 16 or the like, including an overcap or a spray dome. Stem gasket 104 maintains a gas tight seal and can also contact with product.

Material selection for stem gasket 104 requires consideration of the solvent types that the stem gasket will be contacted with.

Metered valve 100 can be connected or clinched to the aerosol can during a filling process, and can be filled according to accepted standard filling methods.

Figure 5B:
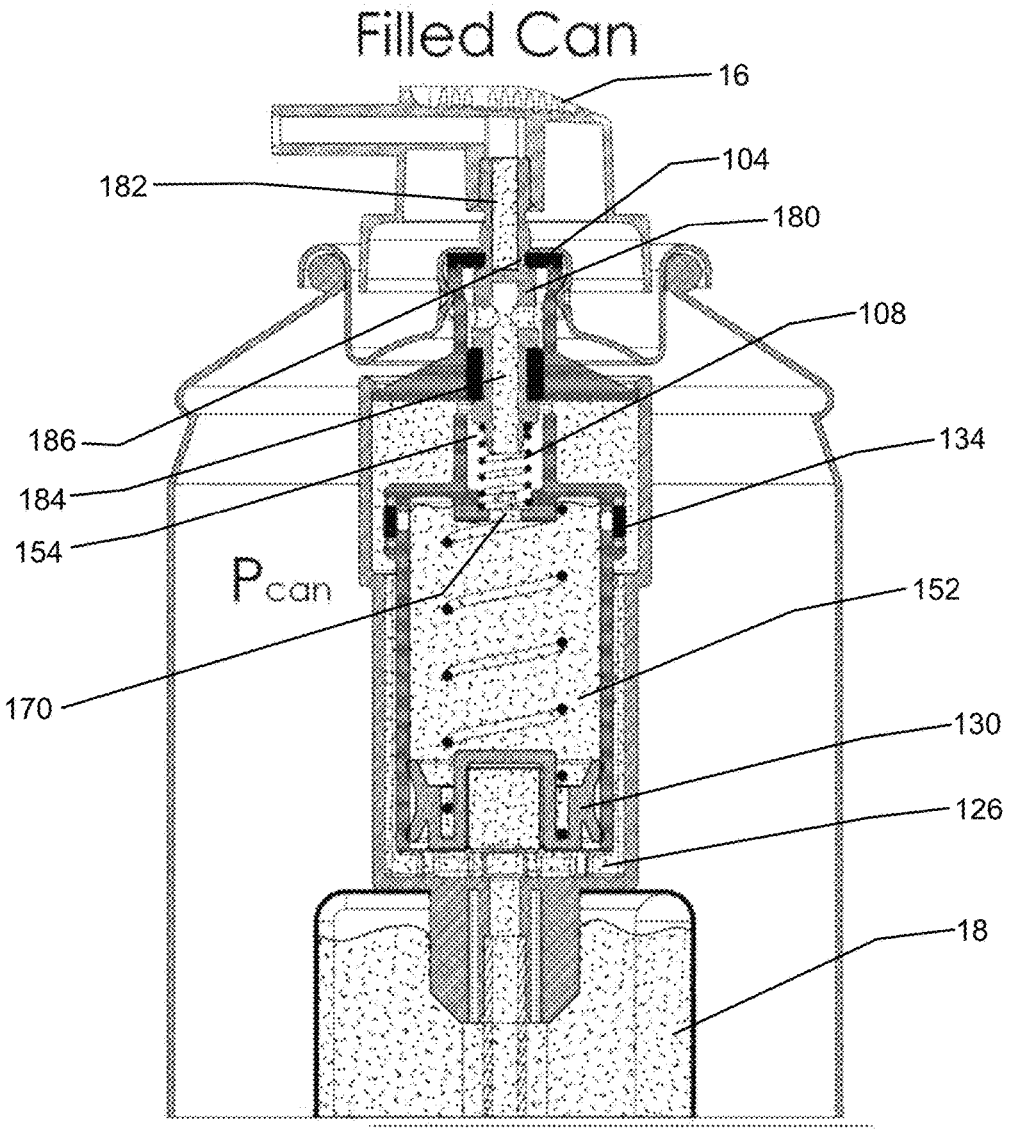
FIG. 5B is a cross sectional view of the device of FIG. 1 shown in a filled state after an initial filling.
Figure 5C:
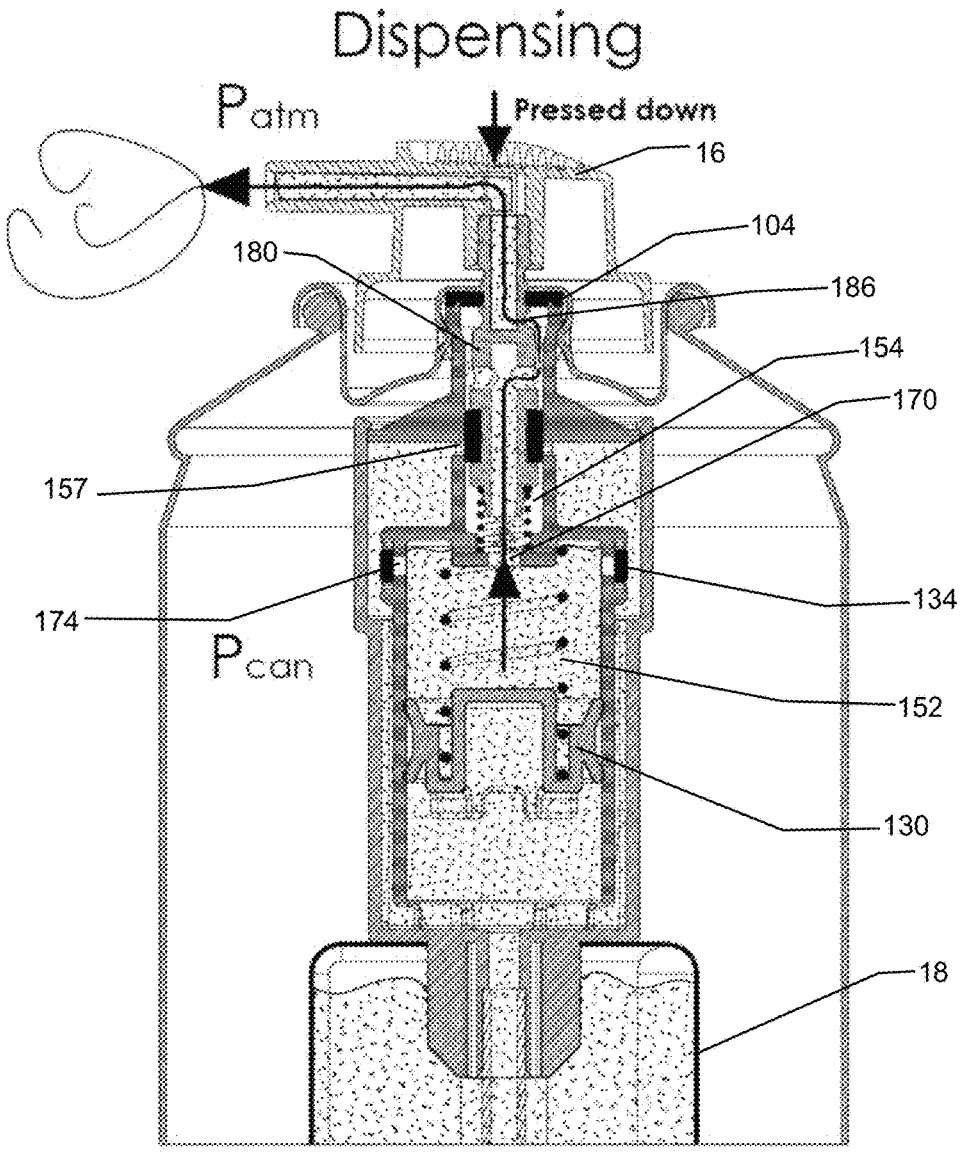
FIG. 5C is a cross sectional view of the device of FIG. 1 shown in a first dispensing state.
Figure 5D:
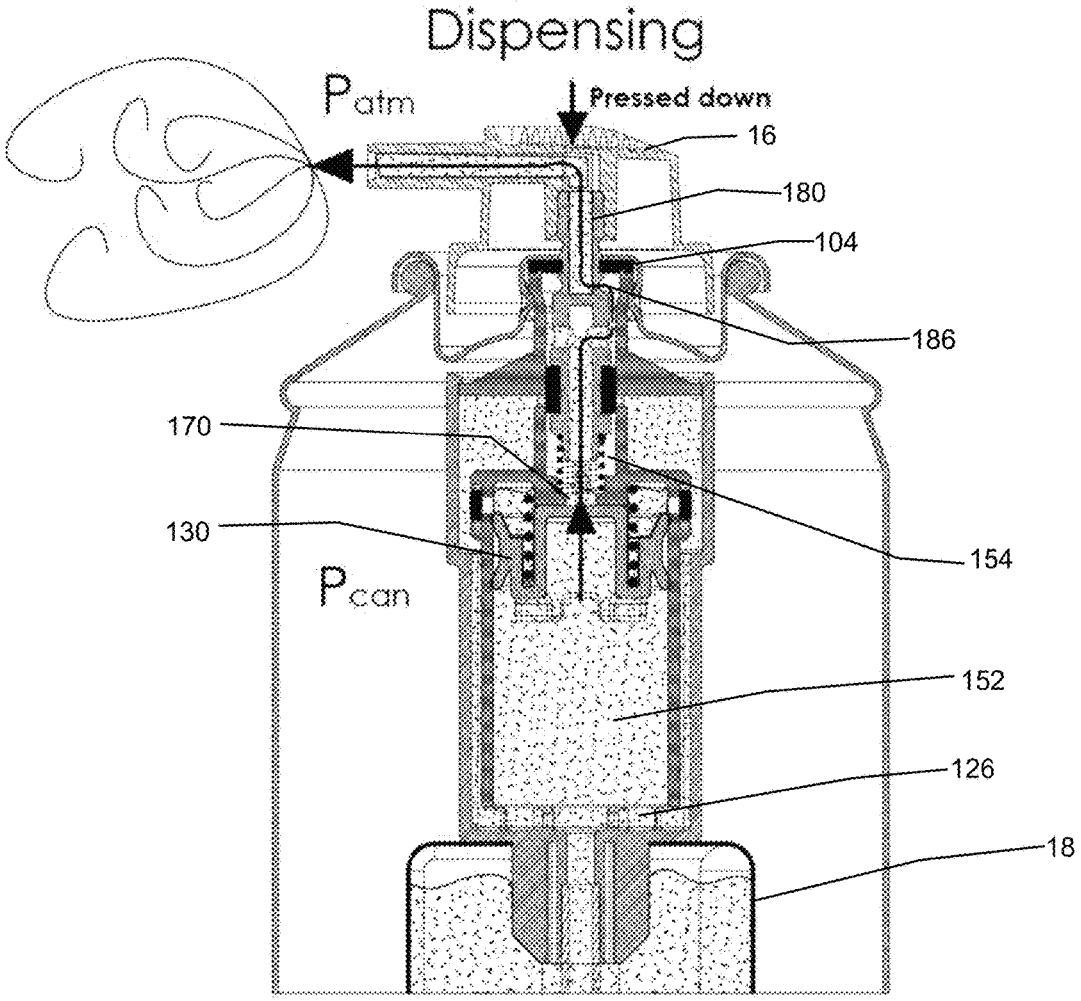
FIG. 5D is a cross sectional view of the device of FIG. 1 shown in a second dispensing state.
Figure 5E:
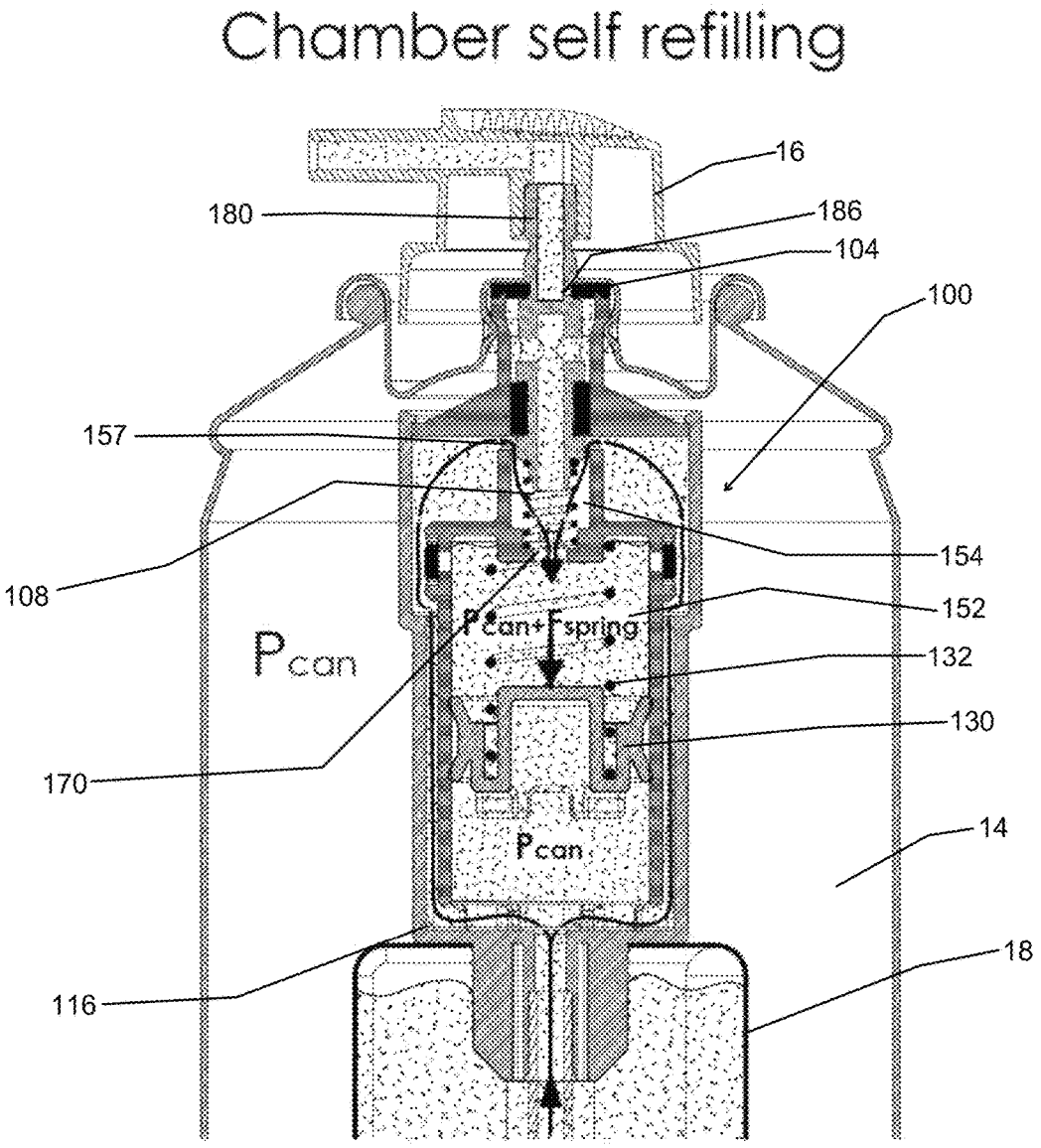
FIG. 5E is a cross sectional view of the device of FIG. 1 shown in a self-refilling state.
Figure 5F:
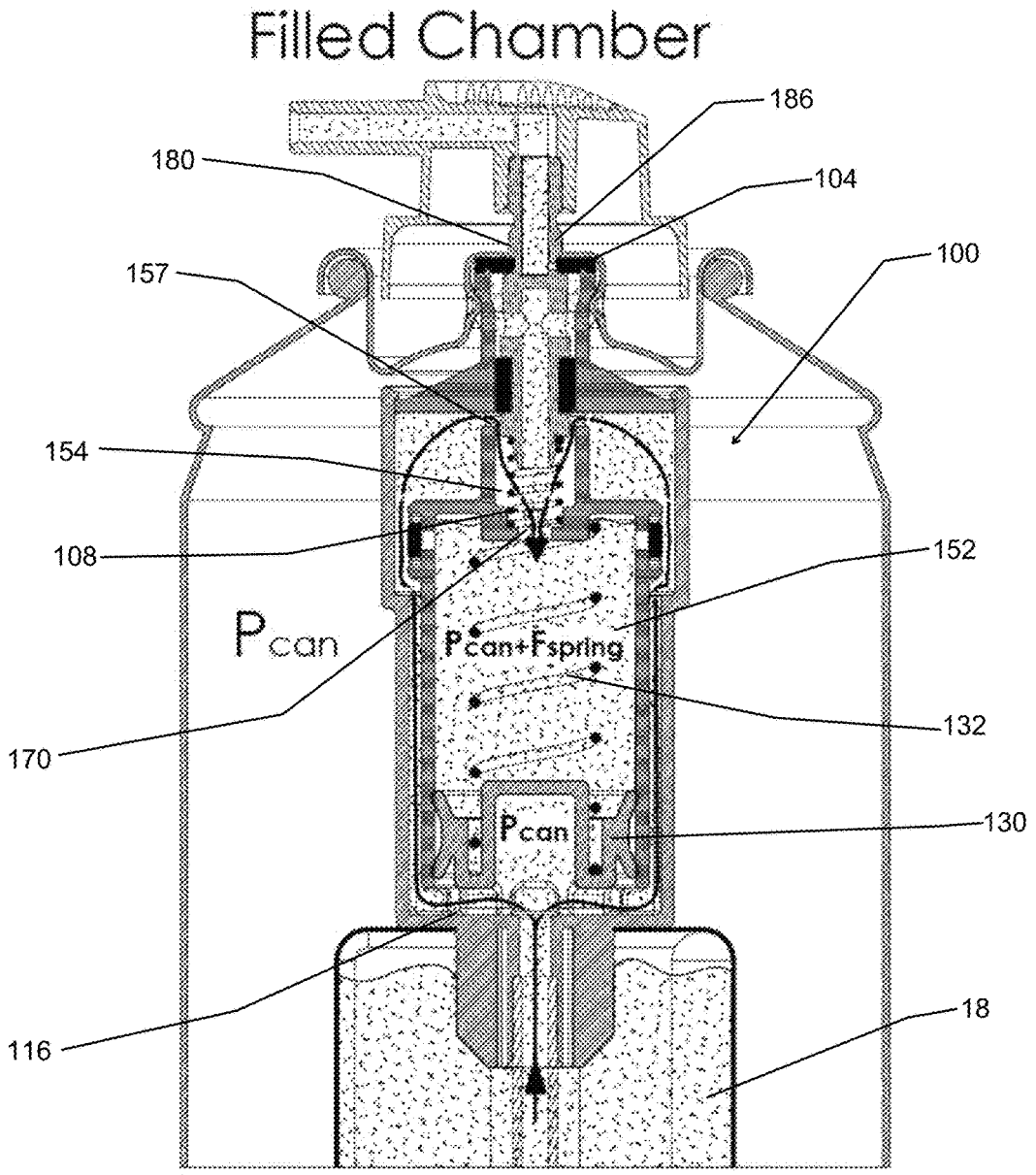
FIG. 5F is a cross sectional view of the device of FIG. 1 shown in a filled state after self-refilling.

Operation of metered valve 100 will now be described with reference to FIGS. 5A to 5F. FIGS. 5A and 5B show the filling of container 12. FIGS. 5C and 5D show dispensing. FIGS. 5E & 5F shows self-refilling. FIG. 5F shows filled container 12.

Referring to FIG. 5A, during the filling process of a device having metered valve 100, when valve stem 180 is pressed downward by a user, stem spring 108 is compressed as shown. Product flows under pressure through upper chamber 182, through aperture 186, and in the following order into and through: stem tunnel 154, aperture 188, lower chamber 184 and dose chamber 152. Again, gasket ring 134 serves as a one-way valve during the filling process. Gasket ring 134 is deflected away from aperture 174 allowing the product to flow between inner surface 114 and outer surface 179 along the channels formed between ribs 124 and feet 126, and ultimately into bag 18. Piston 130 does not affect the filling process. In this position, selector gasket 106 seals aperture 157.

Metered valve 100 surrounds piston 130 through the channels formed between ribs 124 and feet 126 and with aperture 157. This configuration enables the dispensing of high viscosity product due to the wider or larger cross-section areas that enable the product to flow more easily.

The filled can is shown in FIG. 5B. Stem spring 108 exerts an upward force on valve stem 180 pushing it upward in stem tunnel 154 of dosing chamber structure 150. Thus, stem gasket 104 seals aperture 186, thereby disabling dispensing of product, whether metered or unmetered, in this state.

Dose dispensing from metered valve 100 is shown in FIGS. 5C and 5D.

When actuator 16 is pressed down, valve stem 180 is also pushed down, displacing alignment of aperture 186 and stem gasket 104. A pressure difference in dose chamber structure 150, i.e., an atmospheric pressure, causes product from the bag 18 to urge piston 130 upward to dispense all of the product that is accumulated in dose chamber 152. In this position, apertures 157 and 174 are sealed by their respective gaskets so that product can only flow from dose chamber 152 of dose chamber structure 150 through bore 170 into stem tunnel 154.

From stem tunnel 154, product then flows into lower chamber 184, out aperture 188, in aperture 186 to upper chamber 182, and exits through a conduit in actuator 16. Product dispensing ceases when piston 130 reaches an upper surface of lower chamber 184 so that further upward movement is precluded, as shown in FIG. 5D. In this way, metered valve 100 dispenses a fixed dose of product, and not more.

FIGS. 5E and 5F shows how dose chamber 152 of metered valve 100 is automatically refilled upon release of actuator 16. Stem spring 108 pushes valve stem 180 upward so that aperture 186 is sealed by stem gasket 104 and openings or aperture(s) 157 become unsealed. In this state, a pressure difference between the dosing chamber, i.e., atmospheric, and product in the bag 18 exists. This pressure difference causes product to flow to dose chamber 152 of dose chamber structure 150 via aperture 157, through stem tunnel 154, and bore 170. Pressurized product and together with the force of piston spring 132 push the piston 130 downward until base 116 is reached.

At this time, dose chamber 152 of metered valve 100 having been refilled, another fixed dose of product is ready to be dispensed from the metered valve. See FIG. 5F.

It is envisioned that the elements of the present system can be assembled sequentially, in a vertical orientation so that manufacturing is simplified by elimininating a need for a specific angle orientation.

Alternative embodiments are also envisioned.

Figure 6:
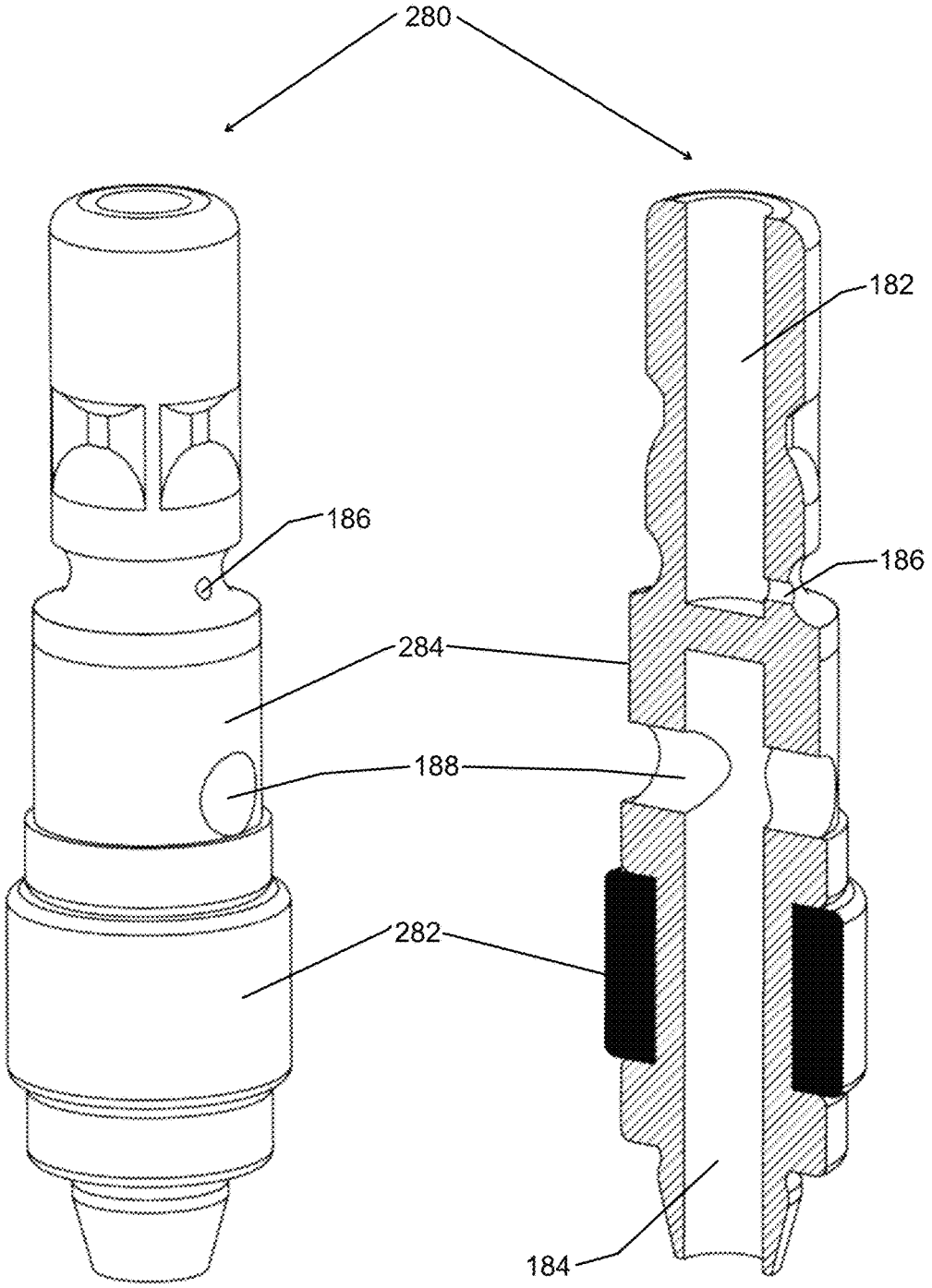
FIG. 6 is a perspective and cross section view of a first alternative embodiment of a valve stem for use in a device according to the present disclosure.

For example, one embodiment shown in FIG. 6 uses a valve stem 280 in place of valve stem 180 and selector gasket 106. Valve stem 280 is manufactured as a single piece from two disparate materials 282 and 284. This manufacturing can use known methods like two component injection molding and over-molding. Valve stem 280 functions substantially the same as the combination of valve stem 180 and selector gasket 106 except that it is a single element.

Figure 7:
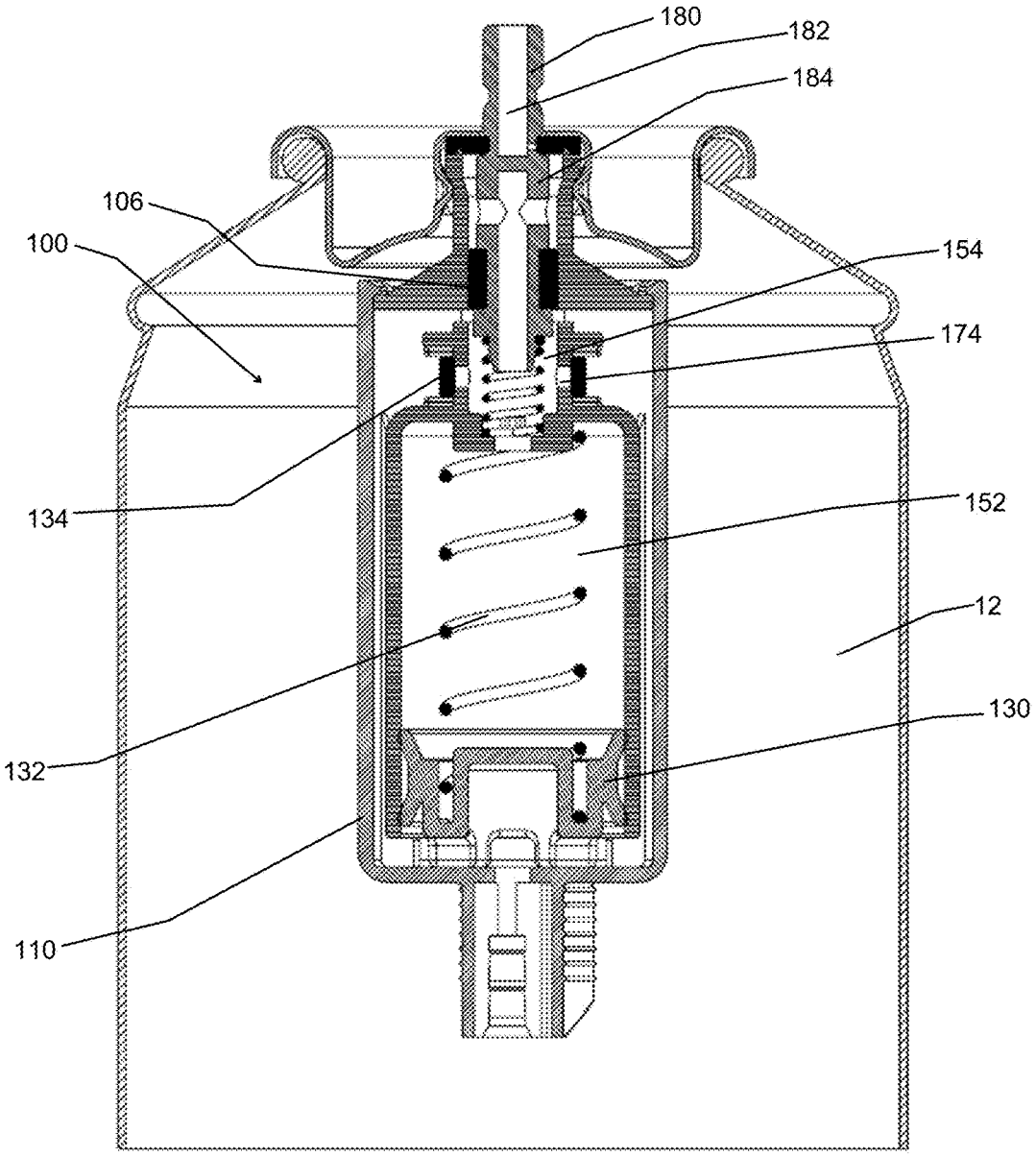
FIG. 7 is a cross sectional view of a first alternative embodiment of the dosing structure according to the present disclosure.

FIG. 7 provides an exemplary embodiment where dosing structure body 150 has as two discreet elements, dose chamber 152 and stem tunnel 154. Further, aperture 174 is through stem tunnel 154, instead of through dosing chamber 152. In this embodiment, gasket ring 134 is disposed around stem tunnel to seal and unseal aperture 174 in accordance with the present disclosure. Accordingly, gasket 134 must be sized to fit around the stem tunnel. Advantageously, the assembly of this embodiment is easier and less complex. Gasket ring 174 needs only to stretch over the stem tunnel.

Figure 8:
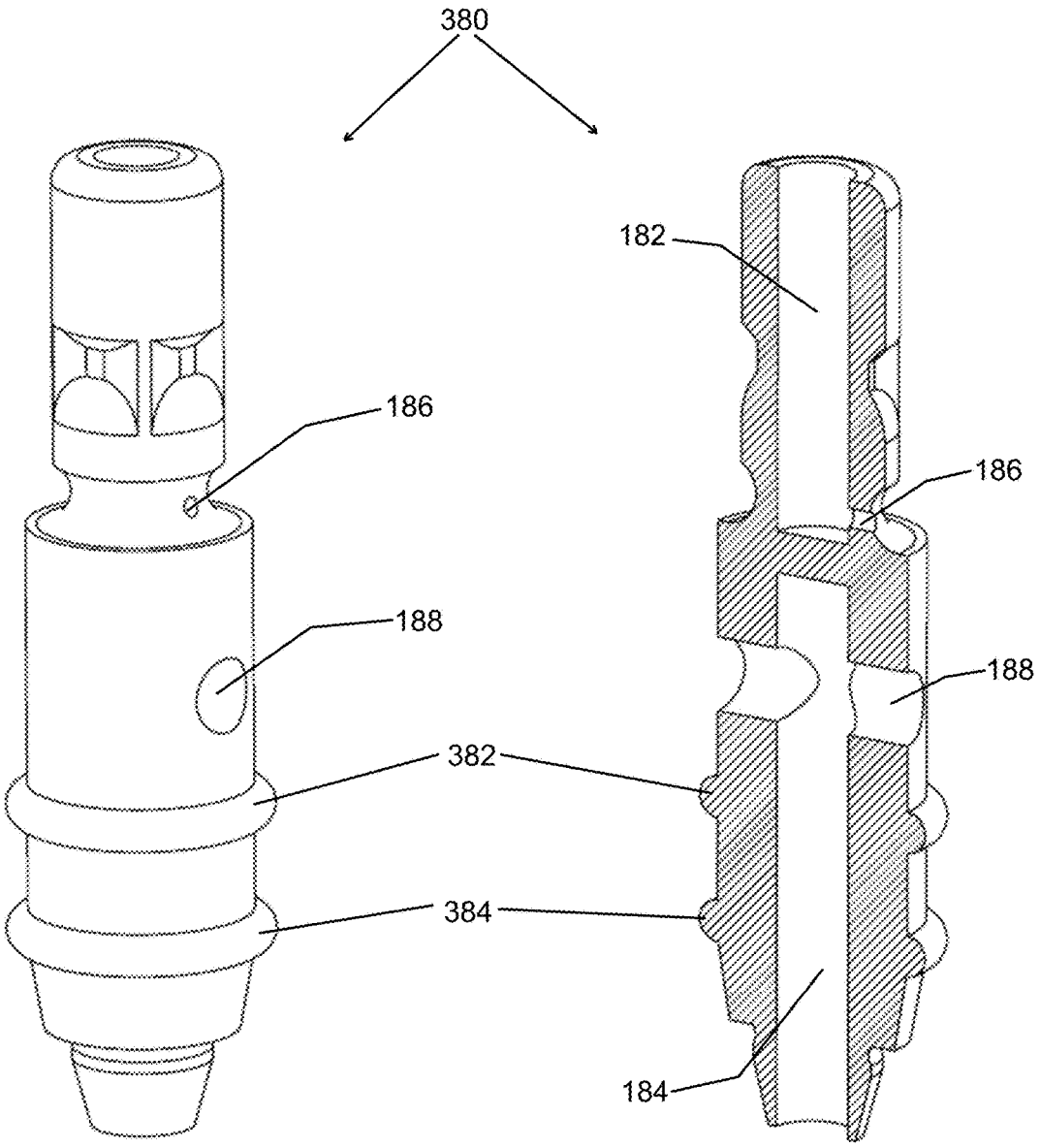
FIG. 8 is a perspective and cross section view of a second alternative embodiment of a valve stem for use in a device according to the present disclosure.
Figure 9:
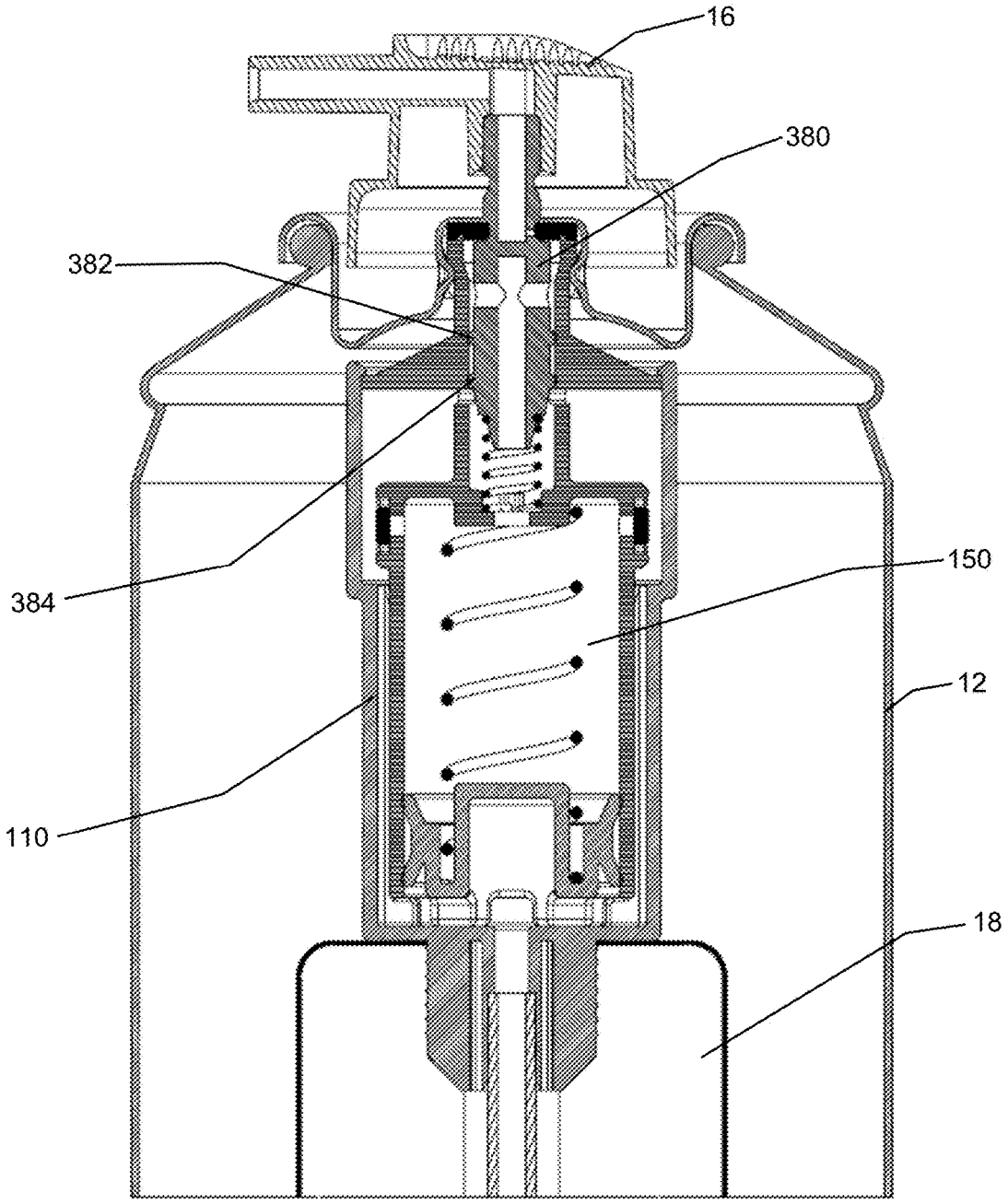
FIG. 9 is a cross sectional view of the device of FIG. 1 with the stem of FIG. 8.

Another embodiment of the valve stem is shown in detail in FIG. 8 and in position in the valve as shown in FIG. 9. In this embodiment, a valve stem 380 is used instead of valve stems 180 or 280. Valve stem 380, like valve stem 280, can be manufactured as a single piece, or like valve stem 180 can comprise a discrete gasket. Rather than a single gasket however, stem 380 has two sealing rings 382 and 384.

Figure 10:
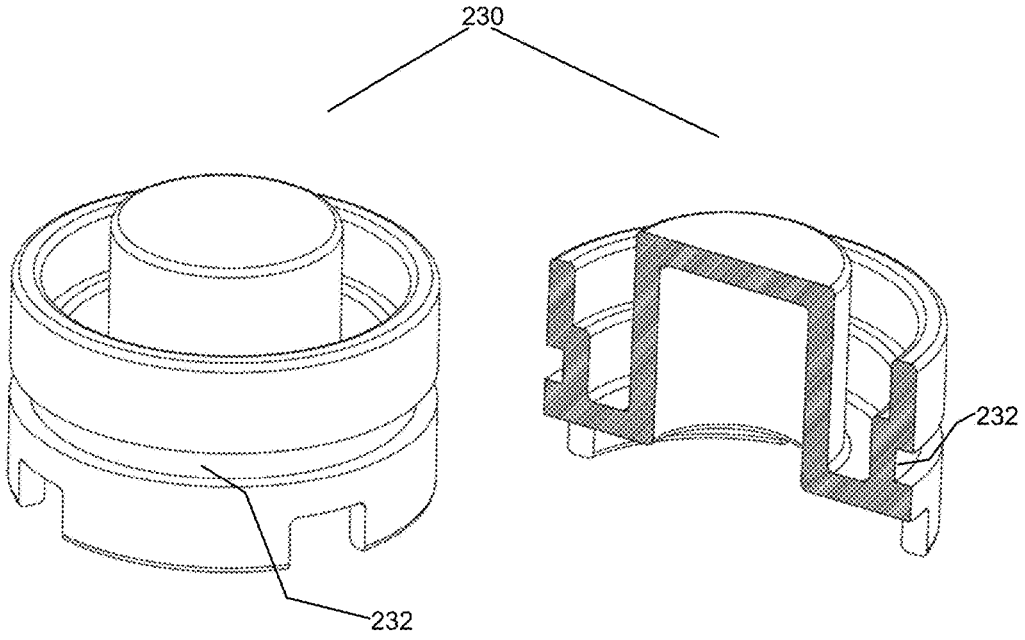
FIG. 10 is a first alternative embodiment of a piston for use in a device according to the present disclosure.
Figure 11:
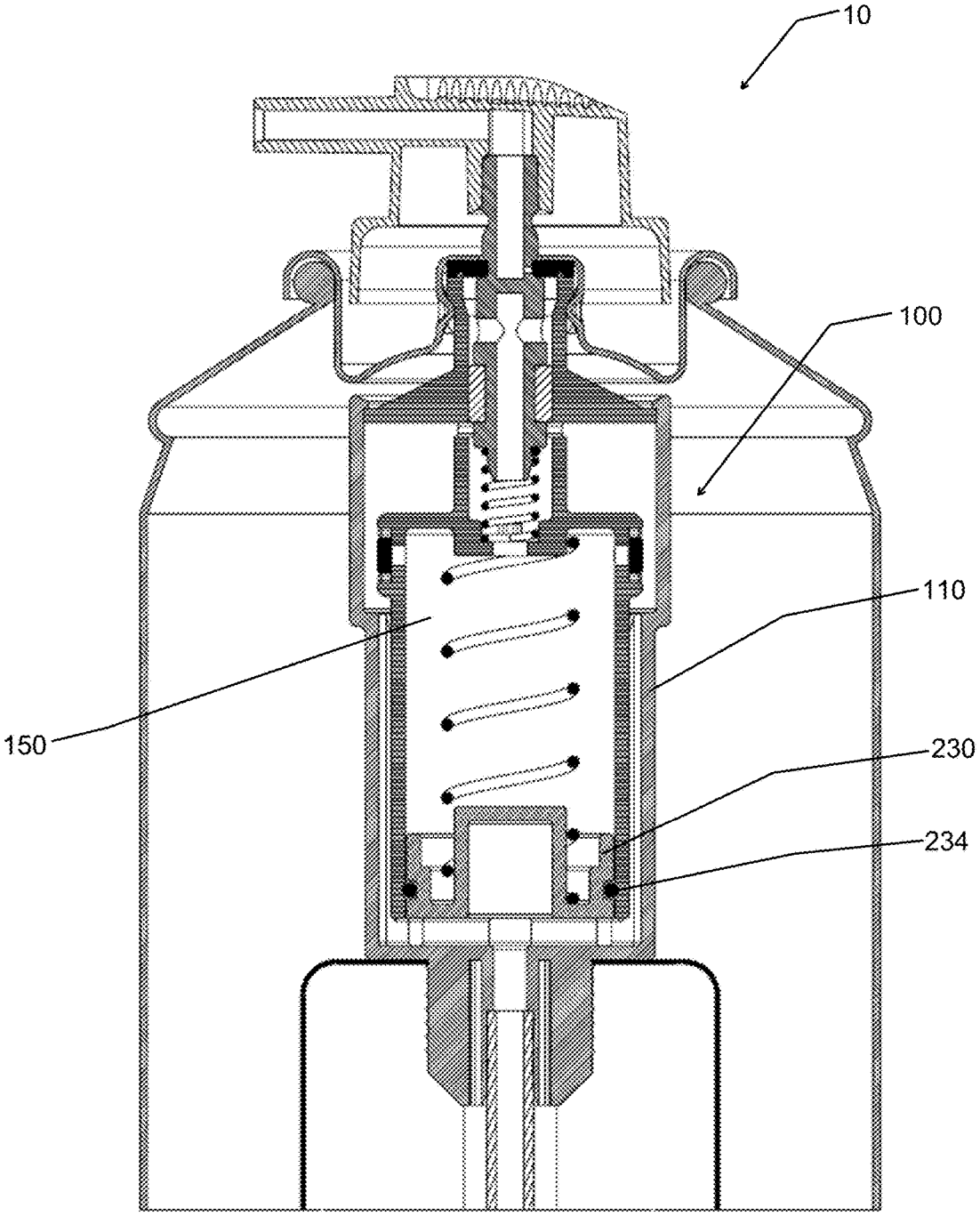
FIG. 11 is a perspective and cross section view of the device of FIG. 1 with the piston of FIG. 10.

In yet another embodiment, a piston 230 is shown in detail in FIG. 10 and in position in the valve as shown in FIG. 11. Piston 230 is used instead of piston 130. Piston 230 has an annular groove 232 into which an o-ring 234 is seated. In this embodiment, o-ring 234, rather than an annular outer surface of the piston, creates the fluid tight seal.

Figure 12:
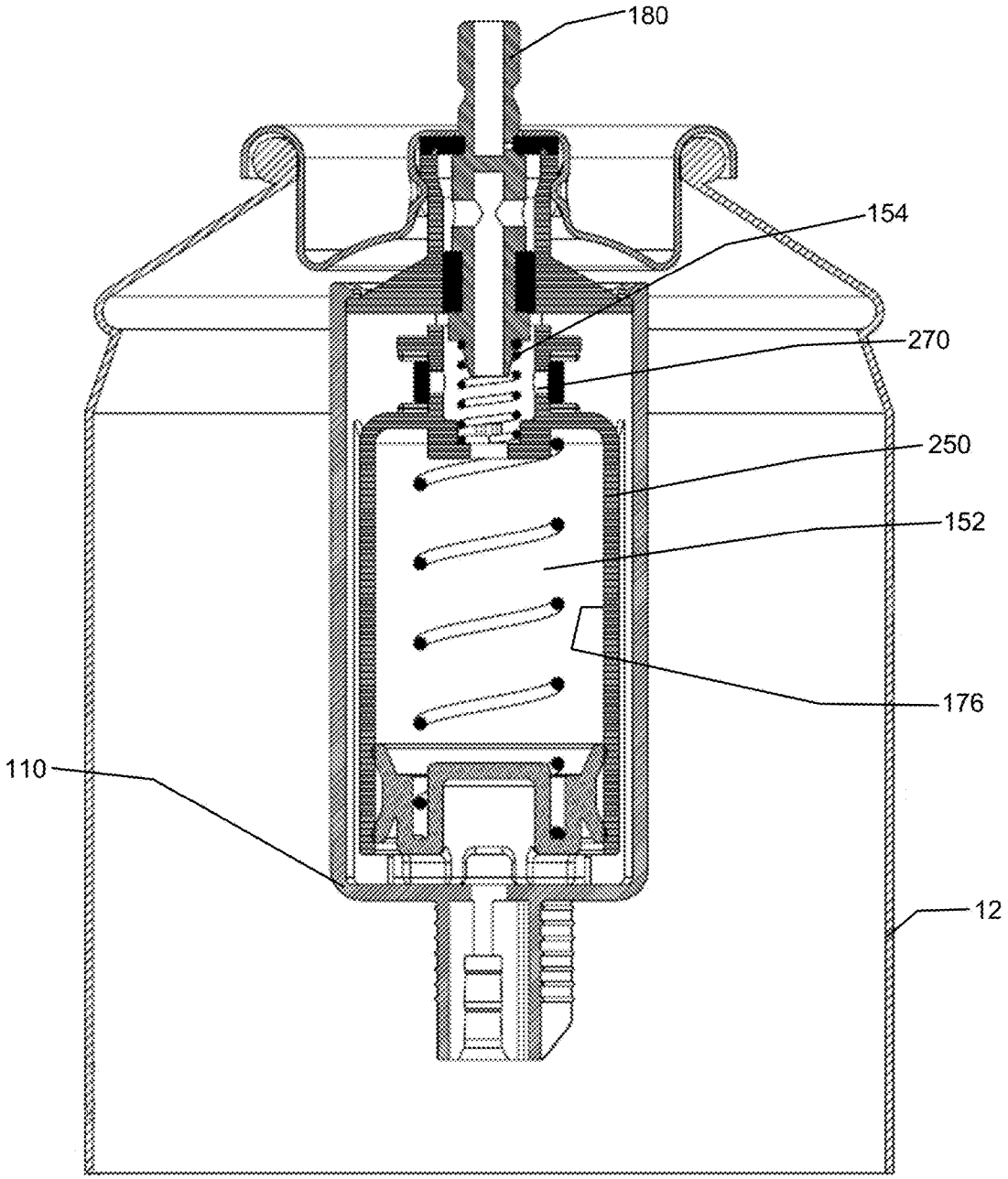
FIG. 12 is a cross section view of the device of FIG. 1 shown with an alternative embodiment of a dosing structure.

In still yet another embodiment of the valve shown in FIG. 12, a dosing chamber structure or body 250 is used instead of body or dosing chamber structure 150. Dosing chamber structure 250, unlike dosing chamber structure 150, does not have any apertures through inner surface 176 of dose chamber 152. Instead, dosing chamber structure 250 has an aperture 270 that is disposed through valve stem tunnel 154 as shown.

Figure 13:
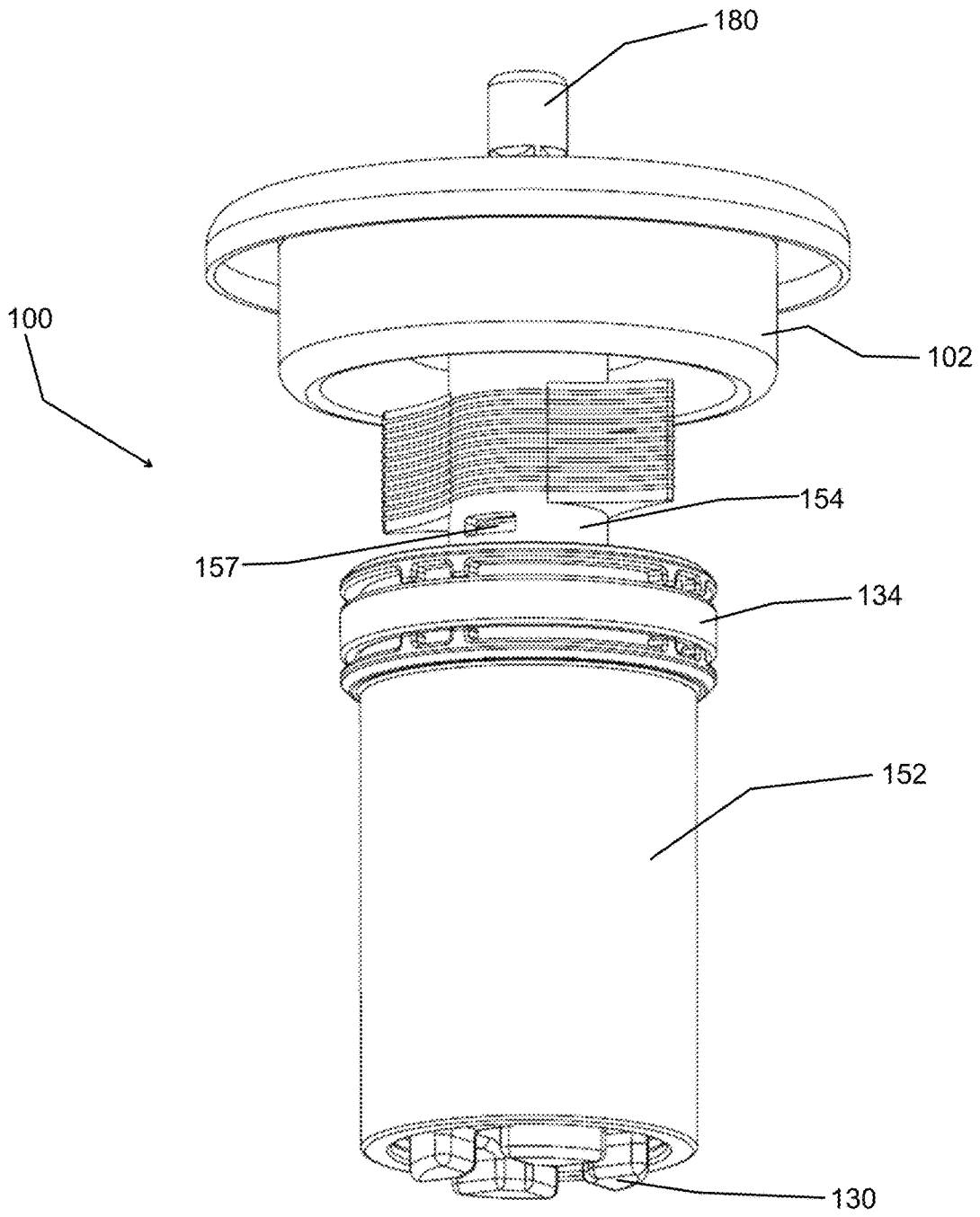
FIG. 13 is a perspective view of a metered valve assembly according to the present disclosure without a valve housing.
Figure 14:
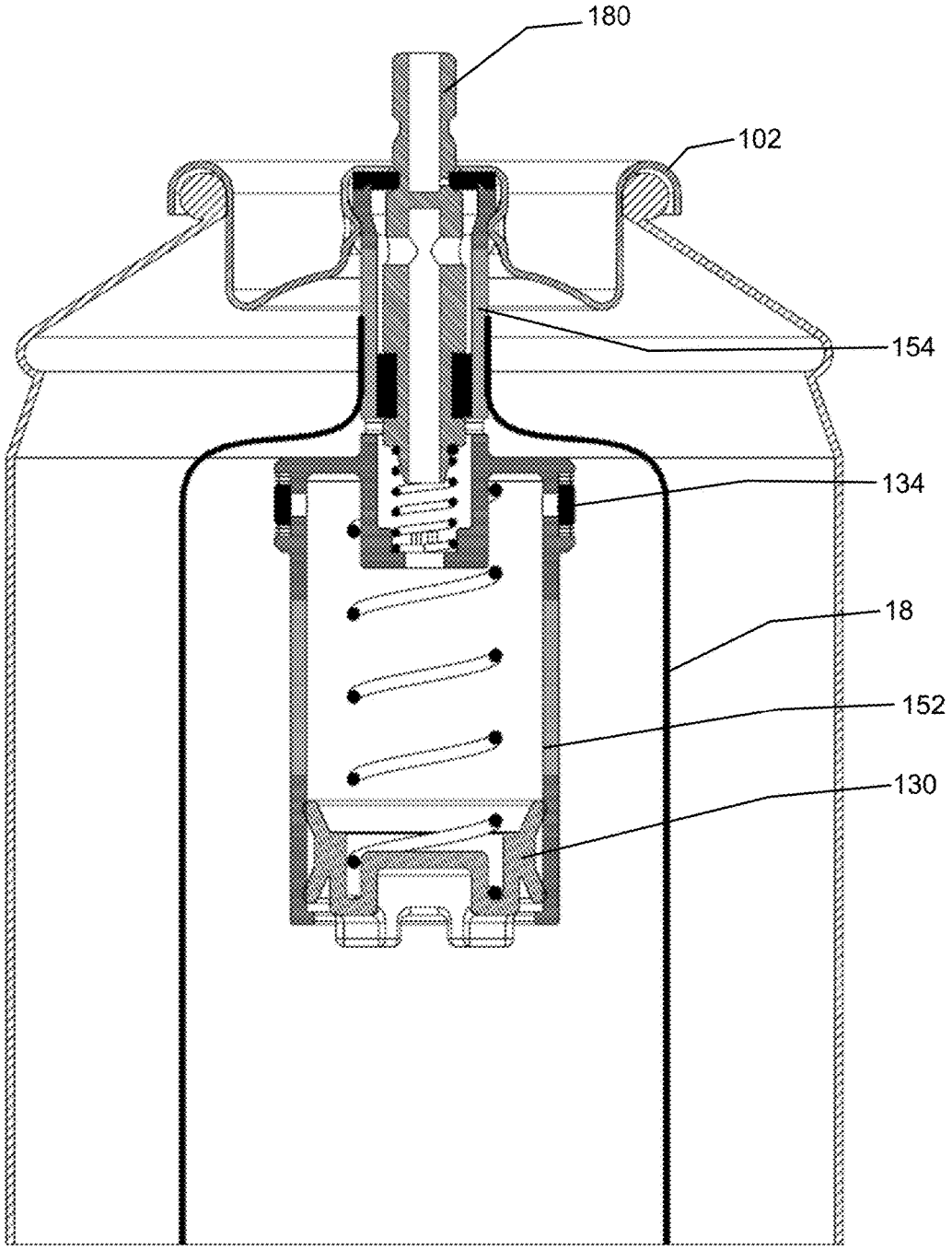
FIG. 14 is a cross sectional view of the metered valve assembly of FIG. 13.

The present disclosure envisions embodiments without a housing. Such embodiments are shown in FIGS. 13 and 14. In such embodiments, bag 18 is disposed around stem tunnel 154 to enclose all of dose chamber 152. Bag 18 is welded thereto at a designated area suitable for attachment.

Figure 15:
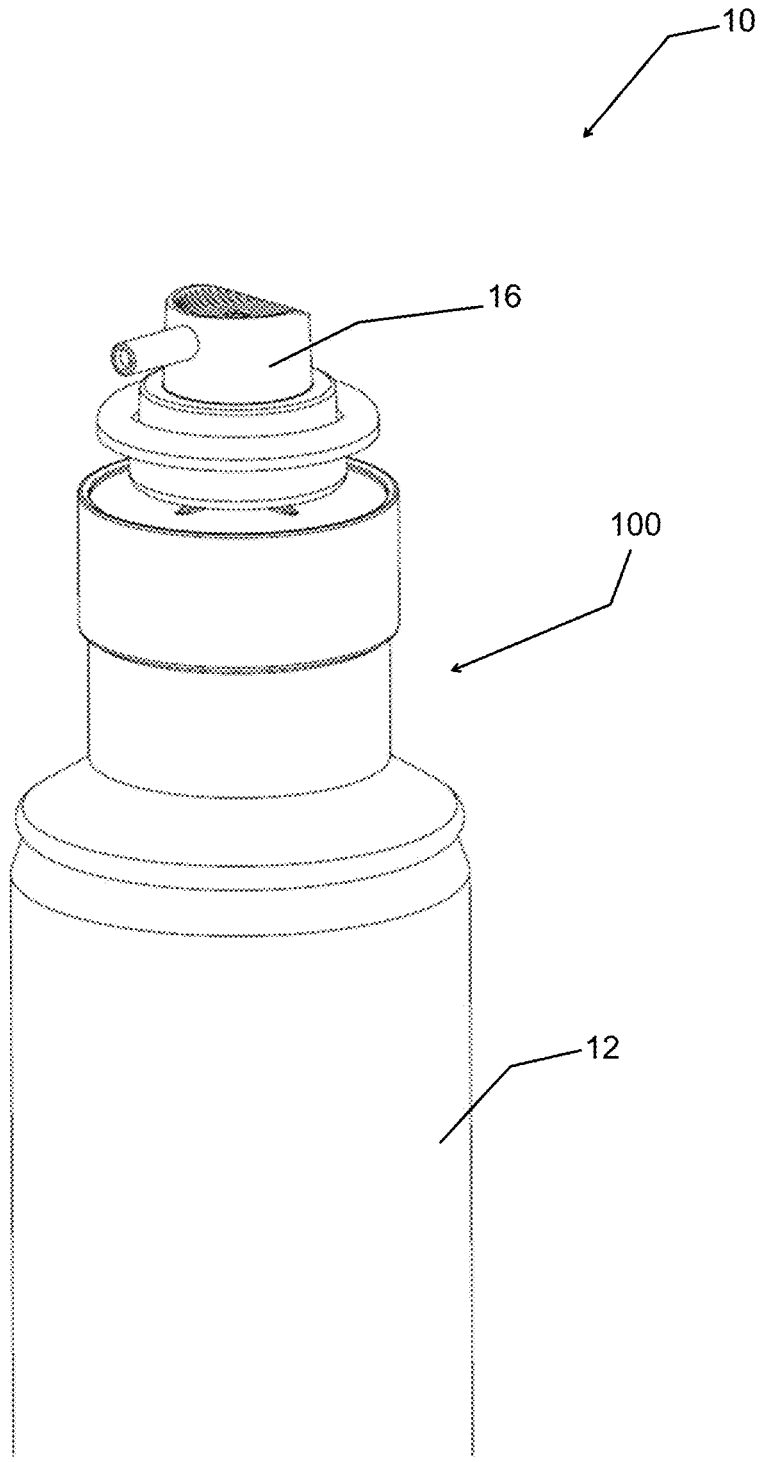
FIG. 15 is a perspective view of a metered valve assembly according to the present disclosure disposed outside of a container.
Figure 16:
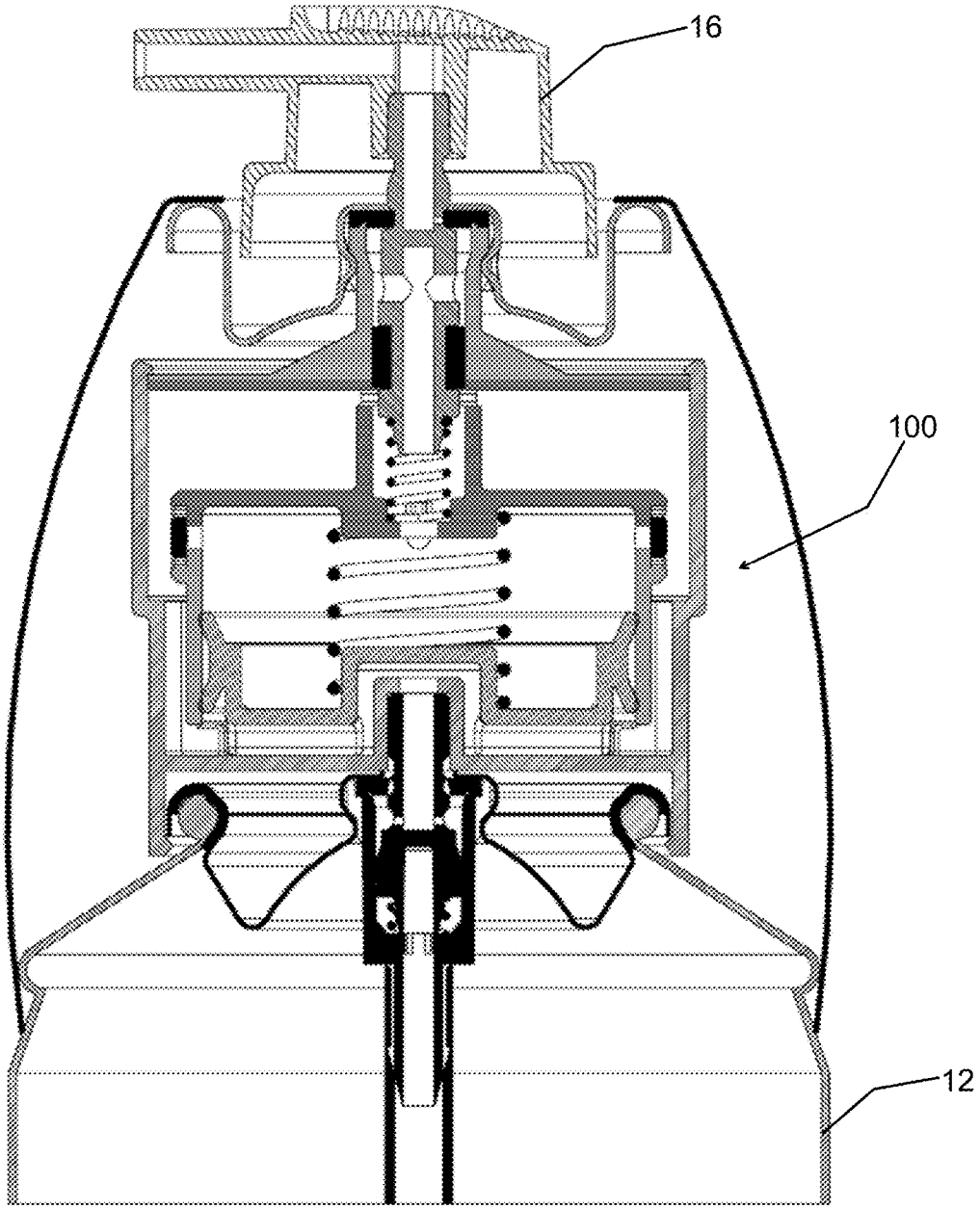
FIG. 16 is a cross sectional view of the metered valve assembly of FIG. 15.

As shown in FIGS. 15 and 16, assembly 100 can also be fitted on or at an outside of a can or container 12. Assembly 100 can also be enclosed by a dome for use as separate unit for dispensing product in doses.

Another embodiment of a metered valve according to the present disclosure, metered valve 400 that is operable in a conventional product filling process to allow for the valve and bag to be vacuumed. Metered valve 400 will now be described with reference to FIGS. 17 to 23.

Metered valve 400 is substantially the same as metered valve 100, but has a housing 410 instead of valve housing 110. Unlike valve housing 110, housing 410 has a groove 412 defined in outer surface 414. Within groove 412, there is at least one through hole 416 communicating with an inner volume of housing 410. Although preferably a circular aperture, through hole 416 can be a slit, or any other suitable geometry. Through hole 416 is preferably a plurality of through holes 416, or more preferably, a plurality of equally spaced through holes 416 along a circumference of groove 412. A housing gasket 418 is positioned below groove 412. Advantageously, housing gasket 418 is slideable into groove 412 during a filling process as will be discussed below.

Metered valve 400 is shown in FIG. 18 being inserted into container 12. A filling head 600 of a filling device is attached to container 12. An example of a filling device is AB175 BOV by Coster Tecnologie Speciali S.p.A. of Calceranica al Lago, Trento, Italy, although other such devices known in the art are suitable. In the state shown in FIG. 18, metered valve 400 is held up by an inner collar of the device so that container 12, metered valve 400, and bag 18 can be vacuumed at the same time. As shown in FIG. 19, this vacuuming can be performed on metered valve 400 because through hole 416 exposes the interior of housing 410 and valve mechanism to a negative pressure being applied by filling head 600. The arrows shown depict an exemplary vacuum flow.

FIG. 20 shows metered valve 400 after the vacuum process. A collet of filling head 600 lowers metered valve 400 into container 12. As metered valve 400 is lowered into container 12, housing gasket 418 engages a rim of container 12 and slides into groove 412, thereby sealing through hole(s) 416. With housing gasket 418 now recessed or slide in groove 412 as shown in FIG. 21, container 12 is then filled with air pressure as part of a standard under the cap filling procedure.

As shown in FIG. 22, metered valve 400 is cinched to container 12 and as shown in FIG. 23, product is transferred into container 12 according to known BOV filling procedures as indicated by the arrow.

In a more preferred embodiment of the valve will now be discussed with reference to FIGS. 24 to 28. In this embodiment, a metered valve 500 has a bypass feature to also permit unmetered dispensing.

Metered valve 500 has the following elements: cup 102, stem gasket 104, valve stem 180, selector gasket 106, stem spring 508, body or dose chamber structure 550, piston spring 132, piston 130 and valve housing 110.

Dose chamber structure 550 is similar to dose chamber structure 150, however dose chamber structure 550 lacks the annular groove 172 and aperture 174 features of dose chamber structure 150. Since an annular groove and aperture are not present in this embodiment, there is a lack of a seat for a gasket ring 134. Thus, this embodiment also has no gasket ring around the dose chamber structure.

Dose chamber structure 550 has a stem tunnel 554. Stem tunnel 554 is longer than stem tunnel 154 and extends down into a dose chamber 552. Significantly, dose chamber 552 is substantially the same as dose chamber 152 except that dose chamber 552 does not have any horizontally disposed apertures, such as aperture 174. Thus, this embodiment uses a longer stem spring 508 than the other described embodiments to allow a longer stroke.

Metered valve 500 operates in two different states: a first dispensing state, or metered state, where valve stem 180 is displaced by a first stroke distance to seal aperture 157 and a second dispensing state, or non-metered state, where the stem is pushed further displaced by a second stroke distance to unseal aperture 157. In the second dispensing state or non-metered state allows the product within the container to flow freely from the bag and bypass the dose dispensing chamber. Such a metered valve 500 is envisioned to be operable with actuators that have multiple strokes or allow for at least two stem states.

Advantageously, when metered valve 500 is in the non-metered or second dispensing state, i.e., metering disabled, metered valve 500 can also be both vacuumed and filled. That is, when aperture 188 and aperture 186 are unsealed, metered valve 500 operates bypassing the metering structures.

As shown in FIG. 24, metered valve 500 is in an assembled, but unactuated state. In FIG. 25, the first dispensing state is shown, whereby product is dispensed in metered doses according to the same principles discussed above with respect to metered valves 100 and 400. In FIGS. 26 to 28, the second dispensing state is shown, with FIG. 26 showing unmetered product being dispensed, FIG. 27 showing vacuuming of the can, and FIG. 28 showing filling through the stem, as indicated by the arrows.

In this more preferred embodiment, valve stem 180 is displaced from about 0.85 to about 3.50 mm for the metered effect, and from about 4.00 to about 5.50 mm for the non-metered effect. The longer stem stroke causes valve stem 180 to travel further down in stem tunnel 554, thereby disabling selector gasket 106 that also allows the valve to be compliantly vacuumed of air.

Selector gasket 106 allows for the dispensing in either a metered or non-metered state of high viscosity products, as well as enabling the vacuum and filling process of container 12. Again, the metered and non-metered option is achieved by using different stem pressing depth. Further, by the use of selector gasket 106 high viscosity product can be emitted or dosed upon a single actuation of valve 100.

This same extended stroke of the stem, namely the second dispensing state, also allows filling through the valve, and unmetered dispensing of product. Accordingly, metered valve 500 is metered in a first state coinciding with a first stroke distance of valve stem 180 and unmetered in a second state coinciding with a second longer stroke distance of the valve stem.

Referring to yet another more preferred embodiment in FIG. 29, a metered valve or valve assembly 600, like metered valve 500, has a valve body 610, a container 612 with an inner volume 614, and a spray cap or actuator 616. As with the embodiment of FIG. 1, container 612 can be, but is not limited to, a can, canister, or any suitable receptacle for holding a product to be dispensed from, and spray cap 616 operates device 600 to control a spray rate of dispensed product. In bag-on-valve (BOV) embodiments, device 600 also has a bag 618 with product therein to be dispensed. Metered valve 600 also has the bypass features of metered valve 500 to permit unmetered dispensing.

As shown in FIG. 29, metered valve or valve assembly 600 has a spacer 700. As shown in FIG. 30, spacer 700 is a tubular or hollow structure 710. Referring to FIG. 30, spacer 700 has a height 740, an inner diameter 730, an outer surface 720, a top surface 780 and a bottom surface 790 (also shown in FIG. 31).

Significantly, spacer 700 can vary the amount of dispensed product as discussed further below. Advantageously, metered valve 600 can be manufactured to have a single set of dimensions or size for the housing 610 and valve stem 680, while the dispensing volume can be varied and controlled by the size of spacer 700. For example, the volume of the dose can be reduced by reducing the volume of travel in the dose chamber by spacer 700 by an amount analogous to the height of spacer 700. Spacer 700 reduces the volume of the dose chamber by a volume of the spacer.

Thus, metered valve 600 simplifies manufacturing and assembly while enhancing versatility of individual components. By the adjustment of the height of spacer 700, the dosage amount or dispensing volume can be adjusted, as desired for the end use application, while all other components of the metered valve 600 remain dimensionally the same.

Referring to FIG. 31, metered valve 600 is analogous to the metered valve 100 of FIG. 2, in that meter valve 600 includes, in order as shown from top to bottom, cup 602, stem gasket 604, valve stem 680, selector gasket 606, stem spring 608, body or dose chamber or chamber structure 650, spacer 700, piston spring 632, piston 630 and valve housing 610. Valve housing 610 is a shell for the dose chamber structure or body 650 that serves to provide a metered dose of product. Spacer 700 is axially aligned in dose chamber 650. In certain embodiments, spacer 700 has an inner diameter that is greater than an outer diameter of stem tunnel 554 so that stem tunnel 554 extends at least partially into spacer 700.

Preferably, outer surface 720 of spacer 700 substantially coincides with the inner diameter of dose chamber 650. Top surface 780 of spacer 700 edges a bottom surface of dose chamber 650. In this embodiment, spacer 700 is sized and maintained in position by a compression fit. The spacer interferes with the moving piston during the metered dispensing, thereby preventing piston 630 from completing a full stroke. Thus, upon actuation, a dosage is dispensed that is equal to an available volume of dose chamber 650 less a volume of spacer 700. In other embodiments without a spacer such as those described above piston 630 can move freely and a full stroke of the piston is possible. Moreover, more product or a larger dosage can be dispensed in an amount equivalent to a volume of the spacer Spacer 700 creates an interference between an upper surface of dose chamber 650 and piston 630 to prevent dose chamber 650 from emptying completely. Upon actuation, piston 630 is urged upward by internal pressure until engaging bottom surface 790.

Dose chamber 650 is a similar to dose chamber 550 but further includes spacer 700 therein. Thus, the height and volume of spacer 700 decreases proportionally the useable volume of dose chamber 650.

Like metered valve 500, metered valve 600 operates in two different states: a first dispensing state, or metered state, where valve stem 680 is displaced by a first stroke distance to seal aperture 157 (shown better in FIG. 3B) and a second dispensing state, or non-metered state, where the stem is pushed further displaced by a second stroke distance to unseal aperture 157.

Again, the amount of product dispensed in the first dispensing state, can be altered by the size and dimension of spacer 700.

The second dispensing state or non-metered state allows the product in container 612 to flow freely from the bag and bypass the dose chamber 650. Such a metered valve 600 is envisioned to be operable with actuators that have multiple strokes or allow for at least two stem states.

Advantageously, when metered valve 600 is in the non-metered or second dispensing state, i.e., metering disabled, metered valve 600 can also be both vacuumed and filled. That is, when aperture 188 and aperture 186 (shown in FIG. 3C) are unsealed, metered valve 600 operates bypassing the metering structures.

Referring to FIGS. 32 and 33, FIG. 32 shows metered valve 600 in a metered state but without the spacer. FIG. 33 shows metered valve 600 in a metered state and with spacer 700. The metered state shown in FIGS. 32 and 33 are at the end of the metered state.

Spacer 700 allows for the manufacture and/or adaption of metered valve 600 to adjust to the needs of the user. Specifically, spacer 700 limits the movement of piston 630 to affect the metered amount. By the use of spacer 700, a customer can control the amount of metered product. Thus, spacer 700 can be configured as desired provided it fits in dose chamber 650 and about stem 680. Moreover, spacer 700 can be sized, especially height 740, as desired by the customer so that the metered amount is controlled as desired.

Although described herein with respect to a BOV system, the present disclosure is also envisioned to apply to dispensing systems that do not employ a bag. However, the ability to function as BOV, makes it also fit to the medical and the food industries, and not just to personal care.

It should also be understood that the metered valve of the present disclosure can be in place outside the container, inside the container or inside the bag (bag-on-valve).

When a certain structural element is described as "is connected to", "is coupled to", or "is in contact with" a second structural element, it should be interpreted that the second structural element can "be connected to", "be coupled to", or "be in contact with" another structural element, as well as that the certain structural element is directly connected to or is in direct contact with yet another structural element.

Unless otherwise stated, as used herein, the term "about" means "approximately" and when used in conjunction with a number, "about" means any number within 10%, preferably 5%, and more preferably 2% of the stated number. Further, where a numerical range is provided, the range is intended to include any and all numbers within the numerical range, including the end points of the range.

As used herein, the terms "a" and "an" mean "one or more" unless specifically indicated otherwise.

As used herein, the term "substantially" means the complete or nearly complete extent or degree of an action, characteristic, property, state, structure, item, or result. For example, an object that is "substantially" enclosed means that the object is either completely enclosed or nearly completely enclosed. The exact allowable degree of deviation from absolute completeness can in some cases depend on the specific context. However, generally, the nearness of completion will be to have the same overall result as if absolute and total completion were obtained.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes can be made and equivalents can be substituted for elements thereof without departing from the scope of the present disclosure. In addition, many modifications can be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope thereof.

The invention claimed is:

1. A metered valve for use in a valve assembly for dispensing a predetermined fixed quantity of product from a container upon actuation, the valve comprising:

a housing having a hollow cylindrical body with an open top, a planar base, an outer surface, and an aperture through the planar base;

a hollow dose chamber having a lower cylindrical body portion with an open bottom end and an upper cylindrical body portion with an open top end, wherein the upper cylindrical body portion projects from the lower cylindrical body portion along a vertical axis, wherein the upper and lower cylindrical body portions are in fluid communication via an aperture through the vertical axis, and wherein the upper cylindrical body comprises an annular disc member projecting radially therefrom;

an annular gasket seated at the open end of the upper cylindrical body;

a valve stem having a bore in a top portion thereof defining an upper passageway, a bore in a bottom portion thereof defining a lower passageway, a first horizontal orifice through the stem communicating with the upper passageway, and a second horizontal orifice through the stem communicating with the lower passageway, wherein the stem is axially displaceable along the vertical axis and is supported by a spring in the upper cylindrical body so that a portion of the stem projects through the annular gasket;

a sealing element disposed about an outer circumference of the lower passageway below the second horizontal orifice;

a piston disposed in the lower cylindrical body and biased against the planar base by a spring and an upper end of the lower cylindrical body; and the dose chamber comprises a horizontally disposed aperture, wherein the horizontally disposed aperture is below the disc member to provide fluid communication with the housing, wherein the dose chamber is disposed in the housing so that the disc member seals the open top end, wherein the stem is displaceable a first distance to dispense a metered dose of the product and a second distance greater than the first distance to dispense a continuous dose of the product.

2. The valve of claim 1, further comprising a spacer.

3. The valve of claim 2, wherein the spacer can be sized as desired so effect the amount of product metered.

4. The valve of claim 2, wherein the spacer interferes with the piston to prevent completion of a full stroke thereby effecting the dosed amount.

5. The valve of claim 1, wherein the dose chamber is supported in the housing by a plurality of feet and a plurality of ribs.

6. The valve of claim 5, wherein the plurality of feet and ribs create clearance and channels for product flow between the dose chamber and an inner surface of the housing.

7. The valve of claim 1, further comprising plurality of vertically disposed ribs spaced apart and projecting radially from an inner diameter of the housing.

8. The valve of claim 7, wherein vertical ribs form channels for fluid flow therebetween.

9. The valve of claim 1, further comprising a plurality of feet projecting upward from a bottom surface of the housing.

10. The valve of claim 9, wherein the plurality of feet are arranged about a circumference of the bottom surface.

11. The valve of claim 5, wherein the valve surrounds the piston through the channels formed between the ribs and feet to enable dispensing of high viscosity product.

12. The valve of claim 1, wherein the annular gasket serves as a one-way valve when filling the container.

13. The valve of claim 1, wherein the housing comprises a tailpiece with a passage in fluid communication with the aperture through the planar base to provide fluid communication with an inner volume of the housing.

14. The valve of claim 13, wherein the tailpiece is directly connected to a bag that contains the product.

15. The valve of claim 1, wherein the dose chamber has an aperture that is disposed through a tunnel of the stem.

16. The valve of claim 1, wherein the stem has a tunnel, and wherein the tunnel has an aperture and the gasket is disposed around the tunnel.

17. The valve of claim 1, wherein the upper cylindrical body portion projects along the vertical axis into the lower cylindrical body portion.

18. The valve of claim 1, wherein the dose chamber is automatically refilled upon release of an actuator.

19. The valve of claim 1, wherein the dose chamber has an aperture disposed through a tunnel of the valve stem.

20. The valve of claim 1 further comprising a selector gasket that allows for the dispensing in either a metered or non-metered state of high viscosity products.

* * * * *